US009292006B2

(12) United States Patent
Takada et al.

(10) Patent No.: US 9,292,006 B2
(45) Date of Patent: Mar. 22, 2016

(54) RADIO-CONTROLLED TIMEPIECE

(75) Inventors: Akinari Takada, Tokyo (JP); Takuji Ike, Tokyo (JP)

(73) Assignees: CITIZEN HOLDINGS CO., LTD., Tokyo (JP); CITIZEN WATCH CO., LTD., Tokyo (JP)

( * ) Notice: Subject to any disclaimer, the term of this patent is extended or adjusted under 35 U.S.C. 154(b) by 49 days.

(21) Appl. No.: 13/637,218

(22) PCT Filed: Mar. 25, 2011

(86) PCT No.: PCT/JP2011/057478

§ 371 (c)(1),
(2), (4) Date: Sep. 25, 2012

(87) PCT Pub. No.: WO2011/118820

PCT Pub. Date: Sep. 29, 2011

(65) Prior Publication Data

US 2013/0016589 A1 Jan. 17, 2013

(30) Foreign Application Priority Data

Mar. 26, 2010 (JP) ..... 2010-072739

(51) Int. Cl.
*G04C 15/00* (2006.01)
*G04F 5/00* (2006.01)
(Continued)

(52) U.S. Cl.
CPC *G04F 5/14* (2013.01); *G04R 20/00* (2013.01); *G04R 20/02* (2013.01); *G04R 20/04* (2013.01); *G04R 20/06* (2013.01)

(58) Field of Classification Search
CPC ..... G04R 20/00; G04R 40/00; G04R 40/02; G04R 40/04; G04R 40/06
USPC ..... 368/47, 155–157, 159–160; 331/1 R, 30
See application file for complete search history.

(56) References Cited

U.S. PATENT DOCUMENTS 4,154,053 A * 5/1979 Chetelat et al. ..... 368/62
5,068,838 A * 11/1991 Klausner et al. ..... 368/47
(Continued)

FOREIGN PATENT DOCUMENTS

CN 1132962 A 10/1996
CN 1610836 A 4/2005
(Continued)

OTHER PUBLICATIONS

Chinese Office Action and English language translation dated Aug. 13, 2013, (8 pgs.).

*Primary Examiner* — Amy Cohen Johnson
*Assistant Examiner* — Daniel Wicklund
(74) *Attorney, Agent, or Firm* — Foley & Lardner LLP

(57) ABSTRACT

A radio-controlled timepiece includes an oscillator circuit of which an oscillation condition can be varied by an oscillation condition adjustment circuit that adjusts an oscillation frequency, a frequency divider circuit that divides the oscillation frequency and generates a time measurement reference timing signal, a frequency adjustment circuit that adjusts the period of time measurement reference timing signal, a local oscillator circuit that uses the oscillation frequency as a reference frequency and outputs a local oscillation frequency, and a control circuit. The control circuit, when the radio-controlled timepiece is performing reception operations, causes the oscillation condition adjustment circuit to operate whereby the oscillation frequency is adjust to an optimal frequency for the local oscillator circuit and the variation setting value of the frequency adjustment circuit is set such that time measurement reference timing signal has a fixed period for normal operations and for reception operations.

18 Claims, 16 Drawing Sheets

(51) Int. Cl.

| | |
|---|---|
| ***G04F 1/04*** | (2006.01) |
| ***G04R 20/00*** | (2013.01) |
| ***G04F 5/14*** | (2006.01) |
| ***G04R 20/02*** | (2013.01) |
| ***G04R 20/06*** | (2013.01) |
| ***G04R 20/04*** | (2013.01) |

(56) References Cited

U.S. PATENT DOCUMENTS

| | | | | |
|---|---|---|---|---|
| 5,361,762 | A * | 11/1994 | Gunter | 600/372 |
| 5,719,827 | A | 2/1998 | Diep et al. | |
| 5,952,890 | A * | 9/1999 | Fallisgaard et al. | 331/18 |
| 6,130,530 | A * | 10/2000 | McNulty | 324/73.1 |
| 6,529,842 | B1 * | 3/2003 | Williams et al. | 702/66 |
| 6,768,704 | B1 * | 7/2004 | Kawaguchi et al. | 368/203 |
| 2003/0083814 | A1 | 5/2003 | Gronemeyer | |
| 2004/0228219 | A1 * | 11/2004 | Miyahara et al. | 368/47 |
| 2007/0026832 | A1 * | 2/2007 | Someya | 455/263 |
| 2007/0140064 | A1 * | 6/2007 | Fujisawa | 368/47 |
| 2007/0286028 | A1 * | 12/2007 | Meltzer et al. | 368/47 |
| 2011/0070851 | A1 * | 3/2011 | Casagrande et al. | 455/131 |
| 2012/0082008 | A1 * | 4/2012 | Eliezer et al. | 368/47 |

FOREIGN PATENT DOCUMENTS

| | | | |
|---|---|---|---|
| CN | 1904773 | A | 1/2007 |
| CN | 1909375 | A | 2/2007 |
| JP | 5-87956 | A | 4/1993 |
| JP | 3333255 | B2 | 7/2002 |
| JP | 2004-294357 | A | 10/2004 |
| JP | 2006-242708 | A | 9/2006 |

* cited by examiner

RADIO-CONTROLLED TIMEPIECE

TECHNICAL FIELD

The present invention relates to a radio-controlled timepiece and particularly relates to a radio-controlled timepiece having a heterodyne receiver circuit.

BACKGROUND ART

Conventionally, radio-controlled timepieces are known that receive standard time and frequency signals, which include time information, and correct the time based on the time information.

There are numerous schemes for configuring the receiver circuit of a radio-controlled timepiece. To receive multiple frequencies, a timepiece uses a heterodyne scheme, where the receiver circuit configuration includes a variable frequency local oscillator and a MIX circuit is known (for example, refer to Patent Documents 1 and 2 below).

Typically, in a heterodyne receiver circuit, a specialized oscillator circuit that maintains high accuracy is used for the reference signal for the local oscillator. However, on top of being costly, such a specialized, high-accuracy oscillator circuit consumes significant power and is large. Therefore, equipping such an oscillator circuit into a system having limited energy and space, such as a radio-controlled timepiece, is difficult.

Thus, in Patent Document 1, a radio-controlled timepiece is disclosed that saves space, is low-cost, and can receive multiple frequencies by employing a heterodyne scheme in configuring the receiver and using, as the reference frequency of a local oscillator circuit, the 32768 Hz-frequency from an oscillator circuit for measuring time.

Further, in Patent Document 2, technology is disclosed that in addition to the configuration disclosed in Patent Document 1, includes a time measurement circuit and a frequency adjusting unit in the oscillator circuit, whereby the reference frequency output by the oscillator circuit is adjusted enabling the most stable oscillation of the local oscillator circuit.

Patent Document 1: Japanese Patent No. 3333255

Patent Document 2: Japanese Laid-Open Patent Publication No. 2004-294357

DISCLOSURE OF INVENTION

Problem to be Solved By the Invention

Nonetheless, when a frequency of 32768 Hz, which is the oscillation frequency of a typical crystal oscillator for time measurement, is used as the reference frequency of the local oscillator circuit, in receiving standard time and frequency signals of, for example, 40 kHz or 60 kHz, the selection of a comparison frequency to be input to a phase comparator circuit is difficult, or multiple comparison frequencies are required, which makes optimization of the frequency divider circuit, which yields the comparison frequencies, difficult and causes deterioration of reception sensitivity.

Further, when multiple frequencies are received, although the oscillation frequency of the local oscillator can be varied by varying the division factor for the frequency divider circuit that yields the comparison frequencies, the division factor at the frequency divider circuit is an integral multiple and at a PLL, which does not maintain a sufficiently high local oscillator frequency, optimization of a comparison frequency for each received frequency is difficult and is a cause of reception sensitivity deterioration.

Consequently, in Patent Document 2, the frequency of the oscillator circuit for time measurement is set to a frequency suitable for a reference frequency of, for example, 30000 Hz and a frequency adjusting unit is provided on the time measurement circuit side, whereby performance of the local oscillator circuit is improved.

Nonetheless, when a 30000 Hz-reference signal is input to a time measurement circuit for which 32768 Hz is assumed, the frequency adjustment range becomes exceedingly large and operation of the frequency adjusting circuit becomes complicated. Further, since frequency adjustment operations have to be performed frequently, various timing signals obtained by the timing measurement circuit become inaccurate. Further, compared to a 32768 Hz-oscillator used as a typical reference signal source for time measurement, oscillators of a particular frequency such as 30000 Hz are costly, arising in a risk of the receiver becoming costly.

An object of the present invention is to provide a low-cost radio-controlled timepiece that simplifies the frequency adjustment circuit and is capable of reducing the number of times frequency operations are performed, by suppressing to a minimum, deterioration of the reception sensitivity and by reducing the frequency adjustment range even when the signal from an oscillator circuit for time measurement is used for the reference frequency of a local oscillator circuit of a heterodyne receiver and for the time measurement signal of a timepiece.

Means for Solving Problem

A radio-controlled timepiece according to the present invention is characterized in having a timepiece measuring circuit as a reference signal source used in time measurement, a heterodyne receiver circuit for receiving radio waves from an external source, and PLL circuit that generates a local oscillation frequency used by the heterodyne receiver circuit. The timepiece measuring circuit serves as a reference frequency generating unit that generates the reference frequency of the PLL circuit in the radio-controlled timepiece, which further includes a control unit that changes the oscillation condition of the timepiece measuring circuit. The control unit changes the oscillation condition of the timepiece measuring circuit based on the reception or non-reception of the radio waves from an external source.

Further, in the invention above, the radio-controlled timepiece of the present invention is characterized in that the control unit changes the oscillation condition such that the oscillation frequency of the timepiece measuring circuit changes according to the reception or non-reception.

In the invention above, the radio-controlled timepiece of the present invention is characterized in that the control unit changes the load capacitance value of the timepiece measuring circuit as the oscillation condition of the timepiece measuring circuit.

In the invention above, the radio-controlled timepiece of the present invention is characterized in that the load capacitance value during reception is set to be greater than the value during no reception.

In the invention above, the radio-controlled timepiece of the present invention is characterized in having a correcting unit that corrects time measurement drift of the time measurement during reception with respect to time measurement during non-reception, the time measurement drift being consequent to the oscillation frequency of the timepiece measuring circuit differing according to reception and non-reception.

In the invention above, the radio-controlled timepiece of the present invention is characterized in having, a frequency divider circuit that divides a signal of the timepiece measuring circuit and generates various timing signals, and a logic variation circuit that adjusts the division factor of the frequency divider circuit to perform accuracy correction of the period of a time measurement signal output from the frequency divider circuit, where the logic variation circuit is used as the correcting unit by correcting the time measurement drift by causing the division factor of the frequency divider circuit to differ for reception and non-reception.

In the invention above, the radio-controlled timepiece of the present invention is characterized in having a frequency divider circuit that divides a signal from the timepiece measuring circuit and generates various timing signals, a reception time measuring unit that measures the time consumed for reception, where the control unit, when reception of the radio waves from an external source fails, adjusts the frequency divider circuit based on the measurement value of the reception time measuring unit and corrects the time measurement drift, whereby the correcting unit is configured by the reception time measuring unit and the control unit.

In the invention above, the radio-controlled timepiece of the present invention is characterized in that the heterodyne receiver circuit to configure to be able to receive multiple frequencies of the radio waves from an external source and the load capacitance value is set to a capacitance value that differs for each reception frequency.

In the invention above, the radio-controlled timepiece of the present invention is characterized in having a frequency divider circuit that divides a signal of the timepiece measuring circuit and generates various timing signals, and a logic variation circuit that adjusts the division factor of the frequency divider circuit to perform accuracy correction of the period of a measurement signal output from the frequency divider circuit, where a smallest changing amount of the period when the period of the measuring signal by the logic variation circuit is greater than a smallest changing amount of the period when the oscillation period of the timepiece measuring circuit is changed by a changing of the load capacitance value, and a storage unit is further included that stores information of a given number corresponding to each reception frequency and for changing the load capacitance value and information a number less than the given number and for causing the division factor of the frequency divider circuit to differ by logic variation circuit.

Effect of the Invention

According to the present invention, even when a signal from a singular reference oscillator is used as both the reference frequency of a local oscillator circuit of a heterodyne receiver and the time measurement signal of a timepiece, deterioration of the reception sensitivity can be suppressed to a minimum and the range of frequency adjustment is reduced, whereby the frequency adjustment circuit can be simplified, enabling a radio-controlled timepiece that reduces the number of times frequency adjustment operations performed to be provided.

Further, during radio wave reception and normal times when radio waves are not received, in each case the oscillation condition of the oscillator circuit can be optimized. Therefore, during normal operations, power consumption can be kept low while high temporal accuracy can be achieved and during reception, a frequency optimal to the receiver circuit can be obtained.

BEST MODE(S) FOR CARRYING OUT THE INVENTION

[First Embodiment]

Figure 1:
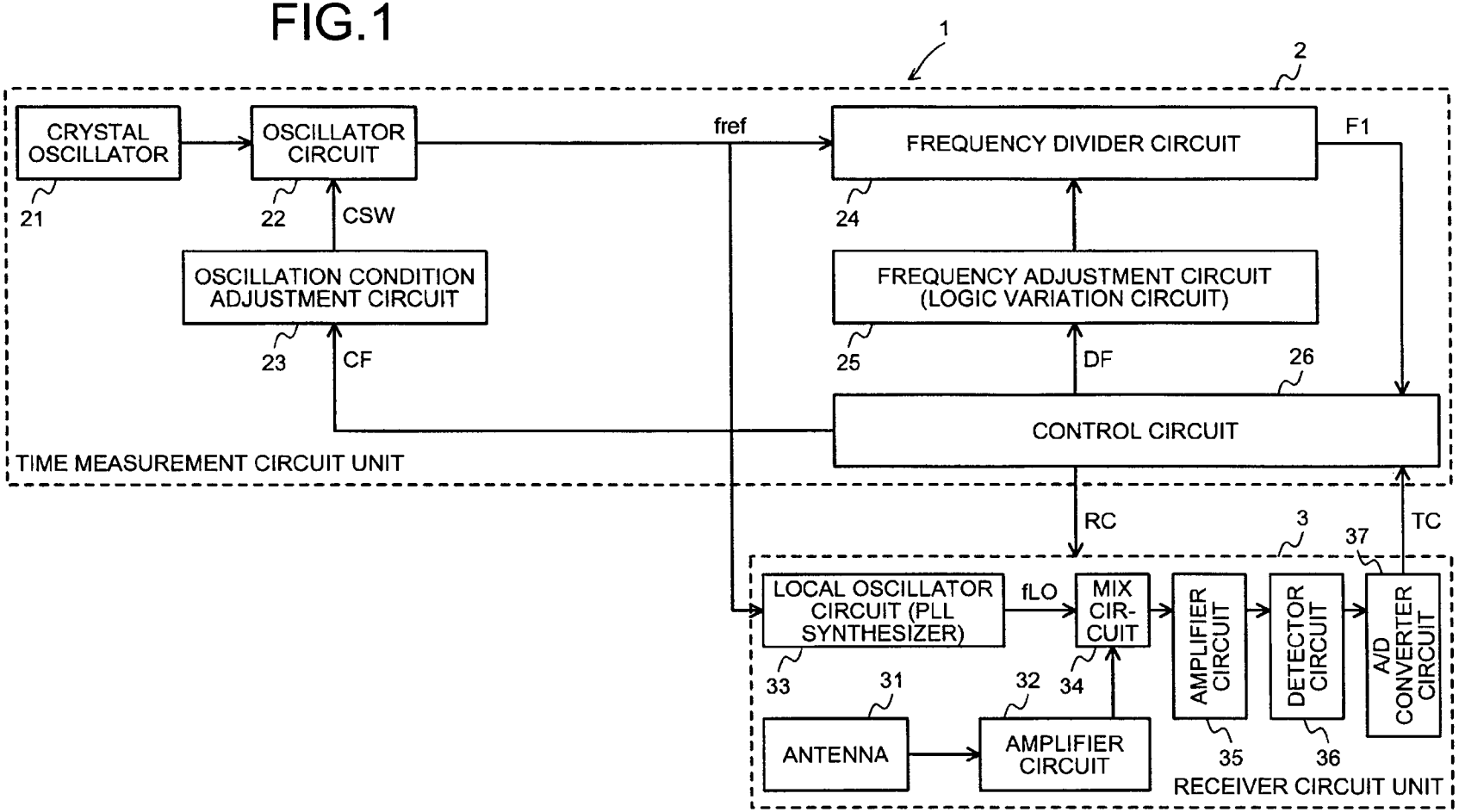
FIG. 1 is a block diagram depicting a configuration of a radio-controlled timepiece according to a first embodiment.

FIG. 1 is a block diagram depicting a configuration of a radio-controlled timepiece 1 according to a first embodiment. As depicted in FIG. 1, the radio-controlled timepiece 1 according to the first embodiment is configured by a time measurement circuit unit 2 and a receiver circuit unit 3.

The time measurement circuit unit 2 includes a crystal oscillator 21, an oscillator circuit 22 that causes the crystal oscillator 21 to oscillate and outputs a reference frequency (oscillation frequency) fref that is a time measurement reference of a timepiece, an oscillation condition adjustment circuit 23 that adjusts the frequency output from the oscillator circuit 22, a frequency divider circuit 24 that divides the frequency fref and generates a timing signal F1 for time measurement and control, a frequency adjustment circuit (logic variation circuit) 25 that adjusts the division factor of the frequency divider circuit 24, and a control circuit 26 that counts the timing signal F1 from the frequency divider circuit 24 and measures the time.

The control circuit 26 outputs control signals to the oscillation condition adjustment circuit 23, the frequency adjustment circuit 25 and the receiver circuit unit 3, and controls operation of the each of the circuits. The oscillation condition adjustment circuit 23 receives a control signal CF from the control circuit 26 and changes an oscillation condition of the oscillator circuit 22, thereby enabling the frequency output from the oscillator circuit 22 to be varied. The frequency adjustment circuit 25 receives a control signal DF from the control circuit 26 and adjusts the division factor of the frequency divider circuit 24, thereby enabling the period of the timing signal F1 from the frequency divider circuit 24 to be varied. The receiver circuit unit 3 determines the operating state of a circuit based on a reception authorizing signal (control signal) RC from the control circuit 26.

The control circuit 26 has a non-depicted time counter and measures the time by counting the timing signal F1 (typically, 1-second periods) from the frequency divider circuit 24. The control circuit 26, as described hereinafter, decodes a digital signal TC from the receiver circuit unit 3 as a time code and based on a result of the decoding, performs control to correct an internal time counter (not depicted) of the control circuit 26. Time correction by the control of decoding along with the decoded time code is not directly related to the present invention and therefore, detailed description thereof is omitted.

The receiver circuit unit 3 is configured using a heterodyne receiver circuit and includes an antenna 31 that receives radio waves, an amplifier circuit 32 for amplifying the received radio waves, a local oscillator circuit 33 that generates a local oscillation frequency fLO, a MIX circuit 34 that combines a local oscillation frequency and reception signals to output an intermediate-frequency signal, an amplifier circuit 35 that amplifies the intermediate frequency signal, a detector circuit 36 that demodulates and detects the received signal, and an A/D converter circuit 37 that converts the detected signal into the 2-value digital signal TC that can be decoded by the control circuit 26. Each of the constituent elements of the receiver circuit unit 3 and the functions thereof are commonly known technologies that are also recited in Patent Documents 1 and 2, and therefore, description thereof is omitted.

The relation between the reference frequency fref and the local oscillation frequency fLO will be described with reference to FIG. 2. At the receiver circuit unit 3, the local oscillator circuit 33, which generates the local oscillation frequency fLO, is an oscillator circuit using a PLL synthesizer and generates the local oscillation frequency fLO by a phase comparison with the reference frequency (signal) fref from the oscillator circuit 22. Consequently, if the reference frequency (signal) fref is not a suitable frequency, drift of the local oscillation frequency fLO occurs.

Figure 2:
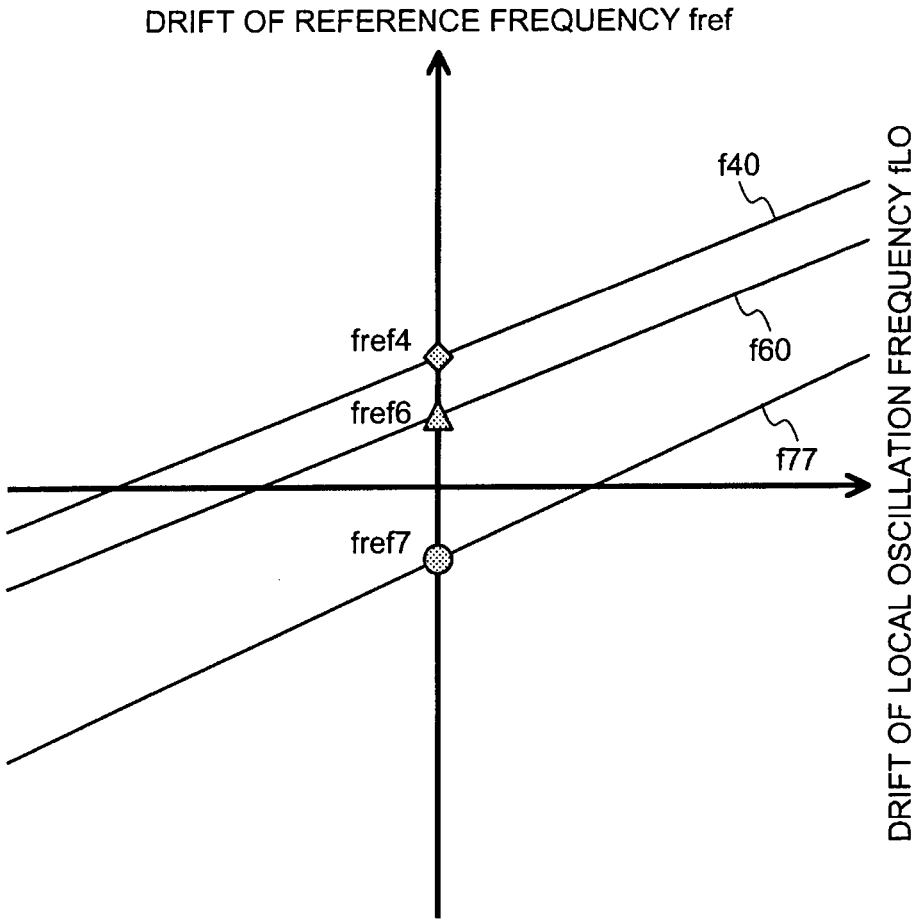
FIG. 2 is a graph depicting changes of a local oscillation frequency fLO with respect to changes of a reference frequency fref.

FIG. 2 is a graph depicting the relation between the reference frequency fref and the local oscillation frequency fLO, where the vertical axis represents the amount of drift from the set frequency of the reference frequency (signal) fref obtained from the oscillator circuit 22 and the horizontal axis represents the amount of drift from the set frequency of the local oscillation frequency fLO obtained from the local oscillator circuit 33. Lines f40, f60, and f77 in the graph depict the relation between the reference frequency fref and the local oscillation frequency fLO, when the reception frequency is 40 kHz, 60 kHz, and 77.5 kHz, respectively. The reference frequency fref as well as the local oscillation frequency fLO are optimal when the respective amounts of drift are 0. From FIG. 2, the following 2 points are known.

Firstly, the optimum values of the reference frequency fref and the local oscillation frequency fLO do not coincide, and irrespective of the reception frequencies, the values at which the amount of drift of the reference frequency fref and the amount of drift of the local oscillation frequency fLO are optimal (0) do not coincide.

For example, when the reception frequency is 40 kHz, in order for the amount of drift of the local oscillation frequency fLO to be optimal (0), the reference frequency fref is a frequency fref4 as indicated by line f40 in FIG. 2. The frequency fref4 deviates from the optimal value (0) of the reference frequency fref. In cases when the reception frequency is 60 kHz and 77.5 kHz, in order for the amount of drift of the local oscillation frequency fLO to be optimal (0), the reference frequency fref is a frequency fref6 and fref7, respectively, each of which deviates from the optimal value (0) of the reference frequency fref, as indicated by lines f60 and f77 in FIG. 14.

Therefore, at the time of reception, to improve reception performance, the amount of drift of the local oscillation frequency fLO has to be optimized (0), while at other times exclusive of the time of reception, the accuracy of time measurement is important and therefore, the amount of drift of the reference frequency fref has to be optimized (0). At the time of reception, although the reference frequency fref is not optimal, the division factor of the frequency divider circuit 24 is changed at the time of reception, whereby the accuracy of time measurement can be maintained to a certain extent.

Secondly, the optimal value of the reference frequency fref differs depending on the reception frequency. Therefore, for each reception frequency, the local oscillation frequency fLO has to be set as the optimal reference frequency fref. Further, when the radio-controlled timepiece 1 can receive signals from multiple transmitting stations, for each reception frequency, a function that can set the optimal reference frequency fref is required. An example of coping with multiple transmitting stations is described hereinafter in a third embodiment.

(Configuration of Oscillator Circuit in First Embodiment)

Figure 3:
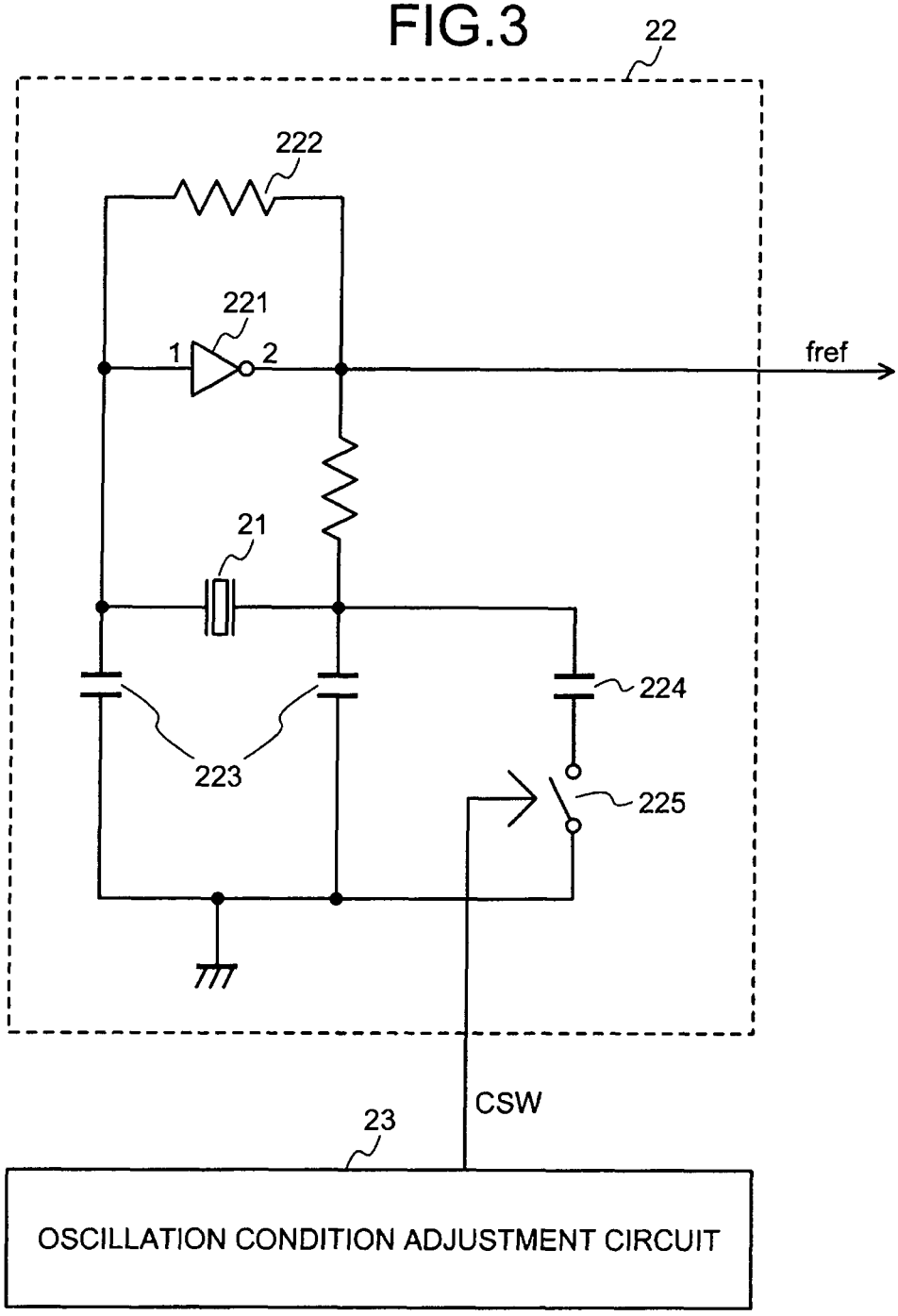
FIG. 3 is a circuit diagram depicting a configuration of an oscillator circuit in the first embodiment.

FIG. 3 depicts an example of a configuration of the oscillator circuit 22 in the first embodiment. In FIG. 3, the crystal oscillator 21 is connected to the oscillator circuit 22 and the oscillator circuit 22 includes an inverter circuit 221, a feedback resistor 222, load capacitors 223, a frequency-adjustment load capacitor 224 that performs frequency adjustment, a frequency adjustment switch 225 that connects the frequency-adjustment load capacitor 224 to the load capacitors 223 in parallel, based on an adjustment signal CSW of the oscillation condition adjustment circuit 23.

During normal times when reception is not performed, the frequency adjustment switch 225 is in an OFF state (open state). In this case, the load capacitors 223 alone are connected to the oscillator circuit 22 as load capacitance. In this state, a frequency (normal frequency) f0 is output from the oscillator circuit 22, as the reference frequency fref.

Meanwhile, when reception is performed, the frequency adjustment switch 225 is in an ON state (connected state). In this case, in addition to the load capacitors 223, the frequency-adjustment load capacitor 224 is connected in parallel to the oscillator circuit 22, and the load capacitance is increased by the amount of the frequency-adjustment load capacitor 224. Consequent to the increase of the load capacitance, the crystal oscillation condition changes and the reference frequency fref output from the oscillator circuit 22 changes. Configuration may be such that during normal times, the frequency adjustment switch 225 is in an ON state (connected state) and during reception, is in an OFF state (open state). In the present embodiment, the reference frequency fref output from the oscillator circuit 22 changes from the normal frequency to an optimal frequency (local oscillation frequency) frx for reception.

In this manner, the capacitance of the load capacitors 223 and the frequency-adjustment load capacitor 224 are suitably selected, whereby the amount that the reference frequency fref output from the oscillator circuit 22 at this time changes can be arbitrarily set. Further, by controlling the frequency adjustment switch 225, the amount that the reference frequency fref changes can be arbitrarily set even according to intermittent connection of the frequency-adjustment load capacitor 224 at constant periods and disconnection thereof. By performing such control, the frequency-adjustment load capacitor 224 can be handled similar to variable capacitance.

By changing oscillation conditions by the method above, the reference frequency fref output from (oscillated by) the oscillator circuit 22 can be changed. However, when the frequency-adjustment load capacitor 224 is connected or disconnected and the oscillation condition is changed, the load capacitance changes with respect to capacitance designed to be optimal for the oscillator circuit 22, and consequently, there is a risk that power consumption of the oscillator circuit 22 will become greater than before the oscillation condition was changed. In particular, when the frequency-adjustment load capacitor 224 is intermittently connected or is disconnected, the capacitance of the frequency-adjustment load capacitor 224 during connection becomes higher compared to continuous connection and consequently, there is a risk that power consumption will increase further. Therefore, as far as possible, the oscillation condition during normal times is preferably a condition whereby the power consumption of the oscillator circuit 22 is low, typically, a state in which the load capacitance is low is preferable.

Normally, the radio-controlled timepiece 1 counts the reference frequency (signal) fref generated by the oscillator circuit 22 via the frequency divider circuit 24, and by counting the timing signal F1 from the frequency divider circuit 24 via the control circuit 26, measures the time. The frequency f0 output from the oscillator circuit 22 is not constant consequent to the drift of circuits configuring the oscillator circuit 22 and the drift of the crystal oscillator 21.

To compensate for the drift above, the frequency adjustment circuit 25, which adjusts the division factor of the frequency divider circuit 24, is provided, and based on a set variation setting value df0, the division factor of the frequency divider circuit 24 is changed at constant intervals, whereby drift of the frequency f0 is compensated. Thus, irrespective of the drift of the frequency f0, the timing signal F1 of a constant period is continuously supplied to the control circuit 26.

(Time Correction Operations of Radio-Controlled Timepiece in First Embodiment)

Figure 4:
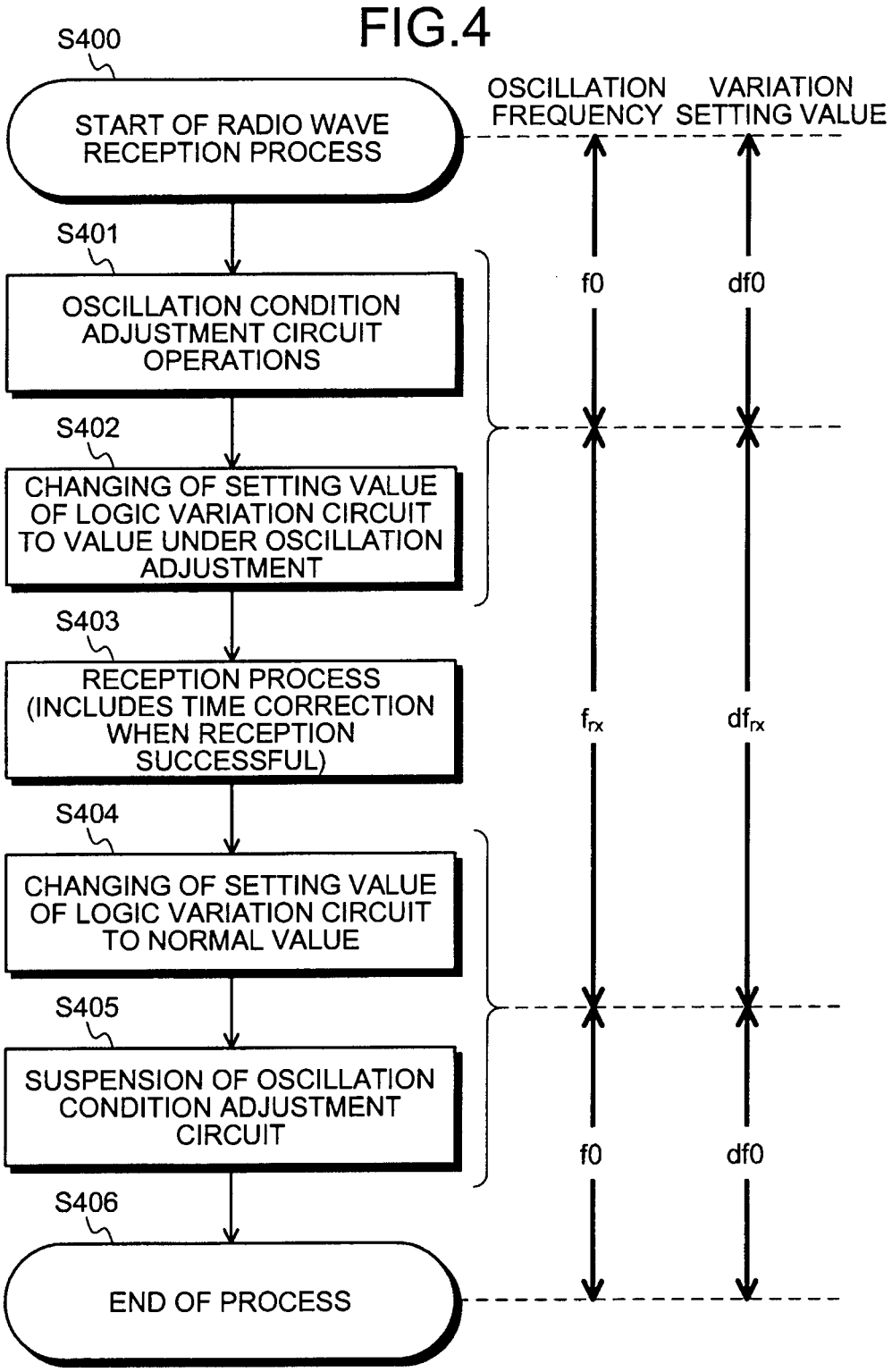
FIG. 4 is a flowchart depicting time correction operations by the radio-controlled timepiece and using standard time and frequency signals.

Time correction operations by the radio-controlled timepiece 1 and using standard time and frequency signals will be described. FIG. 4 is a flowchart depicting time correction operations of the radio-controlled timepiece 1. In FIG. 4, the control circuit 26 of the radio-controlled timepiece 1 receives input of an operation signal via user operation, or realizes that the reception start time has arrived and commences operations of a radio wave reception process (step S400).

When the radio wave reception process at step S400 commences, the control circuit 26 outputs the reception authorizing signal RC to the receiver circuit unit 3. Upon receiving the reception authorizing signal RC, each of the circuits of the receiver circuit unit 3 start to operate. At this time, the frequency f0 input to the local oscillator circuit 33 is not the optimal frequency for the local oscillator circuit 33 consequent to the drift of the circuits configuring the oscillator circuit 22 and the drift of the crystal oscillator 21. Further, even without the drift, with the power consumption and time accuracy required during normal operation, the frequency f0 when the oscillation condition of the oscillator circuit 22 has been optimized does not necessarily coincide with the frequency optimal for the local oscillator circuit 33, but rather is often not optimal.

Therefore, when the radio wave reception process commences, the control circuit 26 outputs the control signal CF to the oscillation condition adjustment circuit 23 and authorizes the output of the adjustment signal CSW. Based on the adjustment signal CSW, the frequency-adjustment load capacitor 224 intermittently connects in parallel or disconnects the load capacitors 223, changes the overall load capacitance of the oscillator circuit 22, and changes the frequency f0 output from the oscillator circuit 22 to the frequency frx (step S401: "oscillation condition adjustment circuit operations").

By suitably selecting the capacitance of the frequency-adjustment load capacitor 224, the frequency frx at that time can be set to a frequency optical for the local oscillator circuit 33. Consequently, the frequency frx, which is suitable, is output from the local oscillator circuit 33 to the MIX circuit 34, enabling radio wave reception sensitivity to be improved.

Further at this time, by changing the frequency from the frequency f0 to the frequency frx, there is a risk that the frequency of the timing signal F1 generated by the frequency divider circuit 24 will change. Therefore, the control circuit 26 outputs the control signal DF to the frequency adjustment circuit (logic variation circuit) 25, changes the variation setting value set in the frequency adjustment circuit 25 to the variation setting value dfrx, and performs adjustment such that the period of the timing signal F1 output by the frequency divider circuit 24 is the same before and after the change of the reference frequency fref (step S402: "changing of setting value of logic variation circuit to value under oscillation adjustment").

In this state, by performing a reception process (step S403), sensitivity deterioration consequent to any local oscillation frequency fLO can be suppressed and at least the period during the reception process and any of the periods of the timing signal F1 from the frequency divider circuit 24 enables the time to be accurately measured. The reception process at step S403 includes time correction when reception is successful. When the reception process at step S403 ends, the control circuit 26 suspends the reception authorizing signal to the receiver circuit unit 3 and the receiver circuit unit 3 suspends operation.

Further, the control circuit 26 issues an instruction to suspend the output of the adjustment signal CSW to the oscillation condition adjustment circuit 23, performs control to return the frequency frx output from the oscillator circuit 22 to the frequency f0 for normal operations (step S404: "changing of setting value of logic variation circuit to normal value"), performs control such that an variation setting value dfrx of the frequency divider circuit 24 becomes the variation setting value df0 during normal operation (step S405: "suspension of oscillation condition adjustment circuit"), and terminates the operations of the radio wave reception process (step S406).

By the process above, even after the operations of the radio wave reception process at step S406 have ended, the time can be accurately measured just as before the operations of the radio wave reception process commenced and the power consumption of the oscillator circuit 22 can be suppressed to a minimum.

In this manner, the oscillation frequency of the oscillator circuit 22 during reception of standard time and frequency signals, which are radio waves from an external source, changes to the frequency frx which differs from the frequency f0 for non-reception, thereby causing variation of the timing signal F1, whereby drifts in the measurement of the time occur. And, these drifts are corrected by the frequency adjustment circuit 25 receiving the control signal DF from the control circuit 26 and adjusting the division factor of the frequency divider circuit 24. In other words, the control circuit 26 and the frequency adjustment circuit 25 are used as a correcting unit that correct drifts in the measurement of the time.

In the process above, by changing oscillation condition, there is risk of the power consumption of the oscillator circuit 22 during reception to increase. However, the reception process is a process on the order of 10 minutes at most and the power consumed by the receiver circuit unit 3 during time correction operations is small enough to be disregarded. Therefore, the affects of such may be disregarded for the most part.

(Effect of First Embodiment)

In the first embodiment, at minimum the following 3 effects are achieved.

Firstly, the radio-controlled timepiece according to the first embodiment can improve reception performance. In the radio-controlled timepiece 1 according to the first embodiment, by including the oscillation condition adjustment circuit 23, the frequency adjustment switch 225, and the frequency-adjustment load capacitor 224 that can adjust the reference frequency fref output from the oscillator circuit 22 during the reception process to be the optimal frequency for the local oscillator circuit 33, the radio wave reception sensitivity can be improved compared to a case where the frequency of the oscillator circuit 22 is not adjusted. Further, even when the drift of the reference frequency fref consequent to the drift of the crystal oscillator 21 is large, the radio wave reception sensitivity can be improved more than that conventionally.

Secondly, the radio-controlled timepiece 1 according to the first embodiment can improve the accuracy of time measurement during reception. Even if the reference frequency fref has changed with respect to the frequency divider circuit 24 that divides the reference frequency fref to become the timing signal F1, which is the time measurement reference, accurate time measurement is possible consequent to the provision of the frequency adjustment circuit 25 that can adjust the period of the timing signal.

Further, the timing signal F1 is used not only for time measurement, but the control circuit 26 decodes the digital signal TC obtained by the receiver circuit unit 3, and uses the timing signal F1 in the decoding process obtaining the result of decoding. According to the timing signal F1 obtained by the frequency divider circuit 24, the control circuit 26 samples the signal level of the digital signal TC obtained by the receiver circuit unit 3 and thereby, obtains the result of decoding the digital signal TC. Therefore, when the period of the timing signal F1 deviates greatly, the sampling period of the digital signal TC determined by the timing signal F1 drifts and there is risk that a correct result of decoding cannot be obtained.

Even if the frequency of the reference frequency fref, which is the reference of the timing signal F1, changes consequent to the operation of the oscillation condition adjustment circuit 23, the period of the timing signal F1 obtained by the frequency divider circuit 24 consequent to the operation of the frequency adjustment circuit 25 is accurately maintained, enabling the control circuit 26 to accurately perform the decoding process.

Thirdly, the radio-controlled timepiece 1 according to the first embodiment, lowered power consumption/high-accuracy time measurement during normal operation and reception performance can be concurrently achieved. During normal operation other than during reception, without consideration of the properties of the receiver circuit, low power consumption and time measurement accuracy that are demanded for electronic time measurement can be set to optimally satisfy the oscillation condition. Consequently, low power consumption and time measurement accuracy for electronic time measurement, and reception performance for a radio-controlled timepiece can be realized without sacrifice of either.

[Second Embodiment]

A second embodiment of the present invention will be described. In the first embodiment, when the frequency f0 output from the oscillator circuit 22 is changed to the frequency frx, the variation setting value set for the frequency adjustment circuit 25 is changed from the variation setting value df0 to the variation setting value dfrx, whereby even when the reception process is in progress, the time can be accurately measured. In contrast, in the second embodiment, the control circuit 26 includes a measuring unit (non-depicted) that without changing the variation setting value set for the frequency adjustment circuit 25, measures the time during which the reception process is performed, in other words, the time during which the frequency output from the oscillator circuit 22 is the frequency frx, and the amount of time measurement drift consequent to changes in the output frequency of the oscillator circuit 22 when reception ends is corrected, enabling accurate measurement of the time even when the reception process is straddled.

(Configuration of Radio-Controlled Timepiece in Second Embodiment)

Figure 5:
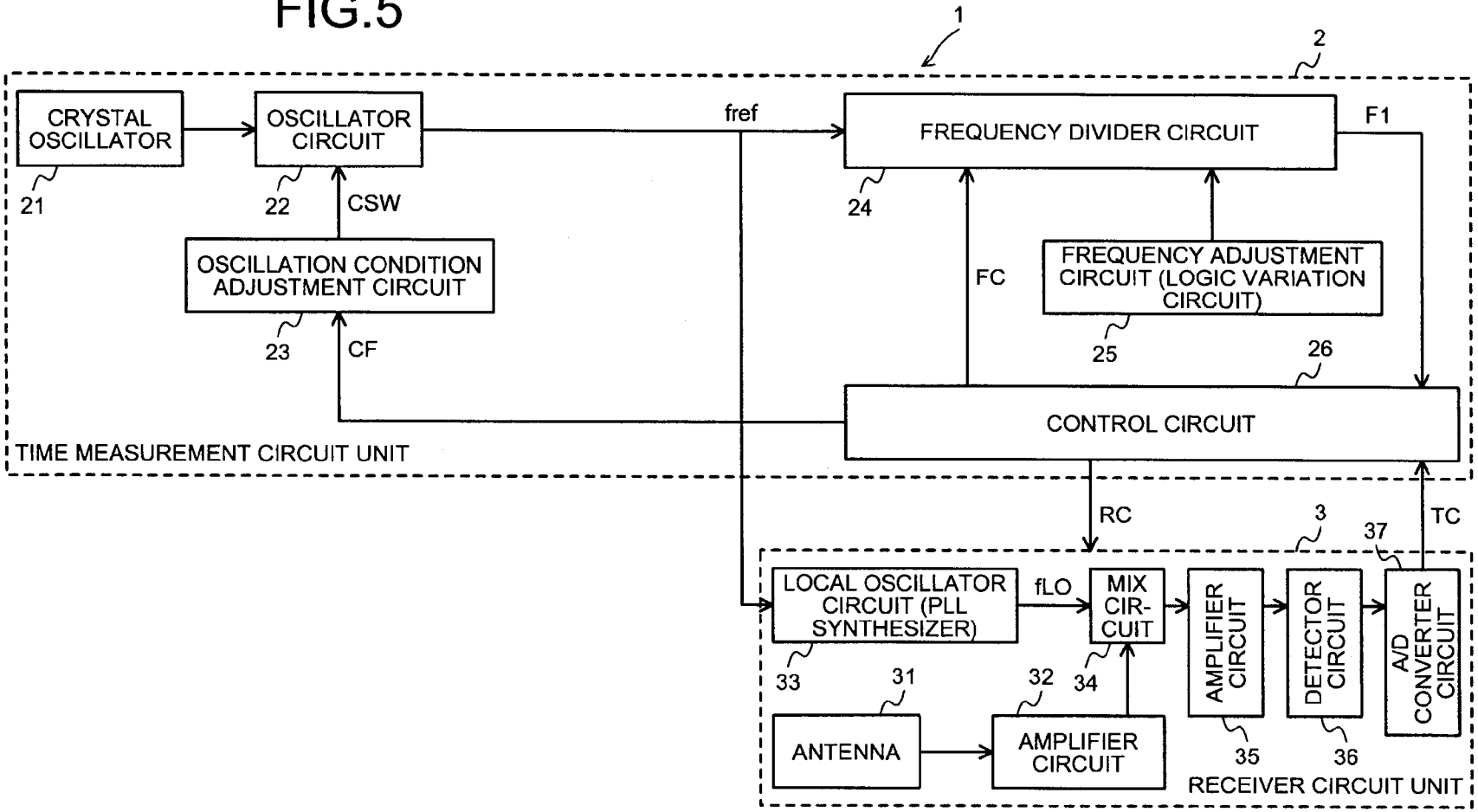
FIG. 5 is a block diagram depicting a configuration of the radio-controlled timepiece in a second embodiment.

FIG. 5 depicts configuration of the radio-controlled timepiece 1 in the second embodiment. In FIG. 5, components identical or similar to those depicted in FIG. 1 and described in the first embodiment are given the same reference numerals used in the first embodiment and description thereof is omitted.

The radio-controlled timepiece 1 in the second embodiment differs from the radio-controlled timepiece 1 in the first embodiment in that the frequency divider circuit 24 of the time measurement circuit unit 2 receives a correction signal FC from the control circuit 26 and can arbitrarily increase the frequency division value during counting.

(Time Correction Operations of Radio-Controlled Timepiece in Second Embodiment)

Figure 6:
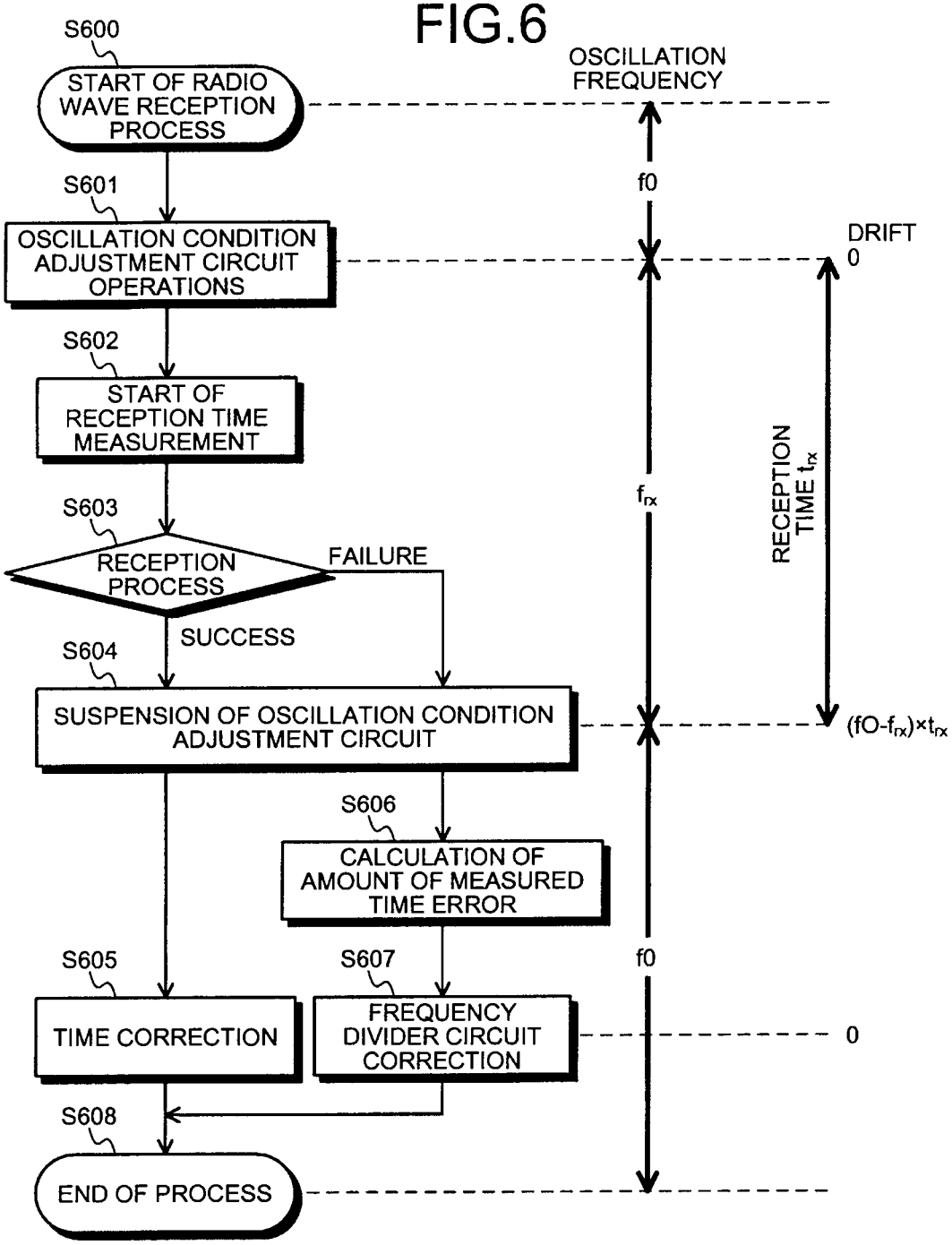
FIG. 6 is a flowchart depicting time correction operations by the radio-controlled timepiece in the second embodiment and using standard time and frequency signals.

Time correction operations by the radio-controlled timepiece 1 and using standard time and frequency signals, will be described using the flowchart depicted in FIG. 6. In FIG. 6, the control circuit 26 of the radio-controlled timepiece 1 receives input of an operation signal via user operation, realizes that the reception start time has arrived and commences operations of the radio wave reception process (step S600).

When the radio wave reception process at step S600 commences, the control circuit 26 outputs the reception authorizing signal RC to the receiver circuit unit 3. When the reception authorizing signal RC is received, circuits of the receiver circuit unit 3 begin to operate. At this time, the frequency f0 input to the local oscillator circuit 33 is not the optimal frequency for the local oscillator circuit 33 consequent to deviations of the circuits configuring the oscillator circuit 22 and of the crystal oscillator 21.

Therefore, when the radio wave reception process commences, the control circuit 26 outputs the control signal CF to the oscillation condition adjustment circuit 23 and authorizes the output of the adjustment signal CSW. By the adjustment signal CSW, the overall load capacitance of the oscillator circuit 22 changes and the frequency f0 output from the oscillator circuit 22 changes to the frequency frx (step S601:

"oscillation condition adjustment circuit operations"). The capacitance of the frequency-adjustment load capacitor 224 is suitably selected, enabling the frequency frx at this time to be set to the optimal frequency for the local oscillator circuit 33.

At this time, the control circuit 26 starts the operation of an internal reception time measuring unit (not depicted), whereby measurement of the reception time commences (step S602), and the time trx consumed for the reception process at step S603 is measured. At this time, the difference of the frequency frx output from the oscillator circuit 22 and the frequency f0 during normal operation is summed as time measurement error.

When the reception process at step S603 ends, the control circuit 26 suspends the reception authorizing signal RC to the receiver circuit unit 3 and the receiver circuit unit 3 suspends operation. At this time, by changing the oscillation condition, the power consumption of the oscillator circuit 22 has the potential of becoming greater than usual and therefore, the control circuit 26 issues an instruction to suspend the output of the adjustment signal CSW to the oscillation condition adjustment circuit 23 and performs control such that the frequency frx output from the oscillator circuit 22 is the frequency f0 during normal operation (step S604: "suspension of oscillation condition adjustment circuit").

Here, in the reception process at step S603, if reception is successful (step S603: success), the control circuit 26 and the frequency divider circuit 24 correct the time according to the received time (step S605: "time correction"), and end the operations of the radio wave reception process (step S608), whereby during the reception process at step S603, even if the summed time of the time measurement error is not accurate, the time measurement error does not become a problem consequent to correction to the correct time.

On the other hand, if the reception at the reception process at step S603 fails (step S603: failure), the control circuit 26, using the time required for the reception process at step S603 as measured by an internal time measuring unit, calculates (f0−frx)×trx as the time measurement error summed during the reception process at step S603, (step S606: "calculation of amount of measured time error"), outputs the correction signal FC to the frequency divider circuit 24 and adjusts the frequency division value according to the amount of error (step S607: "frequency divider circuit correction"), and ends the radio wave reception process operations (step S608).

Consequent to the processes above, the time measurement error summed during the reception process at step S603 is cancelled irrespective of the success or failure of reception and time measurement at an accurate timing becomes possible. In this manner, the oscillation frequency of the oscillator circuit 22 during reception of standard time and frequency signals, which are radio waves from an external source, is attributed to the change to the frequency frx, which differs from the frequency f0 during non-reception, and the time measurement drift consequent to the change in the timing signal F1 is corrected by the control unit 26 adjusting the frequency division value of the frequency divider circuit 24 according to the required reception time measured by the time measuring unit when reception of the radio waves from an external source fails. In other words, the time measuring unit and the control circuit 26 fulfill a role as a correcting unit that corrects drifts in the measurement of the time.

(Effects of Second Embodiment)

In addition to the effects of the first embodiment, the second embodiment achieves an effect in that the configuration of the radio-controlled timepiece 1 according to second embodiment is further simplified. In other words, according to the second embodiment, even if the adjustment value of the frequency adjustment circuit 25 is fixed, the value of the frequency divider circuit 24 is directly corrected, whereby the functional effects identical to those of the first embodiment can be obtained. Accordingly, the circuit configuration of the frequency adjustment circuit 25 and an adjustment value determining step can be further simplified. Moreover, when reception is successful, since operations are performed without correction of the frequency divider circuit 24, functional effects identical to those of the first embodiment can be expected to be achieved by even simpler processes.

[Third Embodiment]

The third embodiment of the present invention will be described. In the third embodiment, configuration is such that the frequency drift during normal times is calculated from a time correction amount during radio wave reception and the elapsed time since the previous reception and the oscillation condition is changed. A block diagram of the third embodiment is identical to FIG. 1 of the first embodiment.

(Time Correction Operations of Radio-Controlled Timepiece in Third Embodiment)

Figure 7:
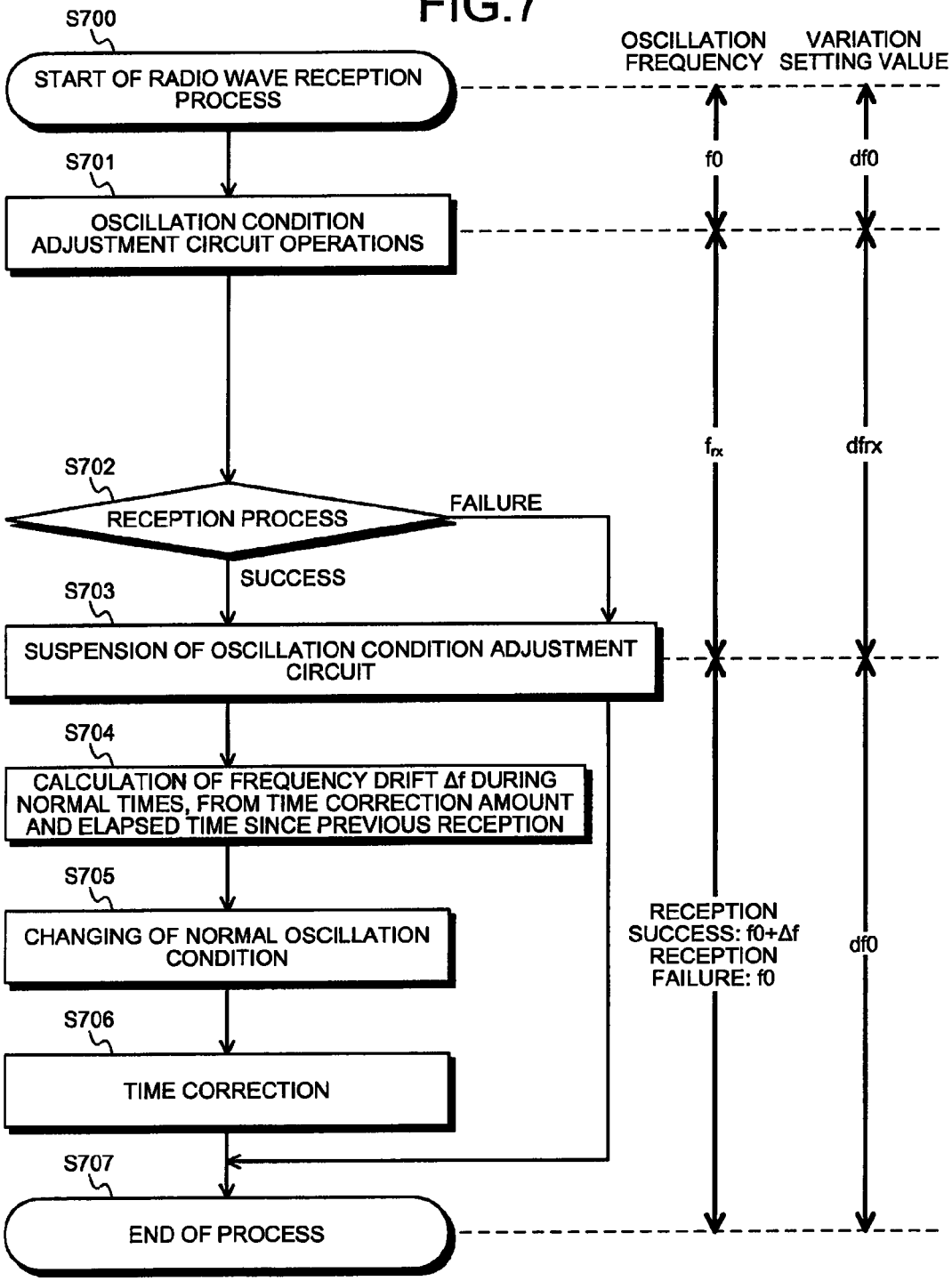
FIG. 7 is a flowchart depicting time correction operations by the radio-controlled timepiece in a third embodiment and using standard time and frequency signals.

Time correction operations by the above radio-controlled timepiece 1 and using standard time and frequency signal will be described using the flowchart depicted in FIG. 7. In FIG. 7, the control circuit 26 of the radio-controlled timepiece 1 receives input of an operation signal via user operation and realizes that the reception start time has arrived and commences operations of the radio wave reception process(step S700).

When the radio wave reception process at step S700 commences, the control circuit 26 outputs the reception authorizing signal RC to the receiver circuit unit 3. When the reception authorizing signal RC is received, the circuits of the receiver circuit unit 3 begin to operate. At this time, the frequency f0 input to the local oscillator circuit 33 is not the optimal frequency for the local oscillator circuit 33 consequent to deviations of circuits the oscillator circuit 22 and of the crystal oscillator 21.

Therefore, when the radio wave reception process commences, the control circuit 26 outputs the control signal CF to the oscillation condition adjustment circuit 23 and authorizes the output of the adjustment signal CSW. By the adjustment signal CSW, the overall load capacitance of the oscillator circuit 22 changes and the frequency f0 output from the oscillator circuit 22 changes to the frequency frx (step S701: "oscillation condition adjustment circuit operations"). The capacitance of the frequency-adjustment load capacitor 224 is suitably selected, enabling the frequency frx at this time to be set to the optimal frequency for the local oscillator circuit 33.

When the reception process at step S702 ends, the control circuit 26 suspends the reception authorizing signal RC to the receiver circuit unit 3 and the receiver circuit unit 3 suspends operation. Here, in the reception process at step S703, if reception is successful (step S702: success), Δf, which is the frequency drift during normal times, is calculated from the time correction amount and the elapsed time since the previous reception (step S704), the value of a load capacitor 244 is adjusted according to the value of Δf, and the normal oscillation condition is changed (step S705), whereby the time accuracy during normal times is improved. The control circuit 26 and the frequency divider circuit 24 perform correction according to the received time (step S706: "time correction"), and end the operations of the radio wave reception process (step S707).

On the other hand, if the reception process at step S702 fails (step S702: failure), without performing any operation, the operations of the radio wave reception process are ended (step S707). During non-reception and reception, the variation setting value set for the frequency divider circuit 24 is as depicted in FIG. 7 and identical to the first embodiment, and thus, description thereof is omitted.

(Effects of Third Embodiment)

In addition to the effects of the first embodiment, the radio-controlled timepiece according to the third embodiment further achieves an effect in that during normal times, time measurement with favorable accuracy is possible.

[Fourth Embodiment]

A fourth embodiment of the present invention will be described. In the first embodiment, the second embodiment, and the third embodiment, the local oscillation frequency fLO output from the local oscillator circuit 33 is singular, i.e., describe embodiments in a case where a singular reception channel alone is received. In this case, the local oscillation frequency fLO output from the local oscillator circuit 33 is singular and therefore, there is only 1 reference frequency fref optimal for the local oscillator circuit 33.

In contrast, in the fourth embodiment, with consideration of application to multi-channel reception, the local oscillation frequency fLO output from the local oscillator circuit 33 are plural, i.e., an embodiment where multiple reception channels are received will be described. In the first embodiment, as described with reference to FIG. 2, in this case, the frequency fLO output from the local oscillator circuit 33 are in plural and therefore, the reference frequency fref optimal for the local oscillator circuit 33 changes depending on the local oscillation frequency fLO.

Therefore, in the fourth embodiment, the frequency-adjustment load capacitor 224 is provided in plural and by controlling the oscillation condition adjustment circuit 23, the reference frequency fref output from the oscillator circuit 22 can be varied among multiple frequencies. Consequently, the reference frequency fref optimal for the local oscillation frequency fLO corresponding to each reception frequency can be supplied to the local oscillator circuit 33 and radio wave reception sensitivity can be further improved.

(Configuration of Radio-Controlled Timepiece in Fourth Embodiment)

Figure 8:
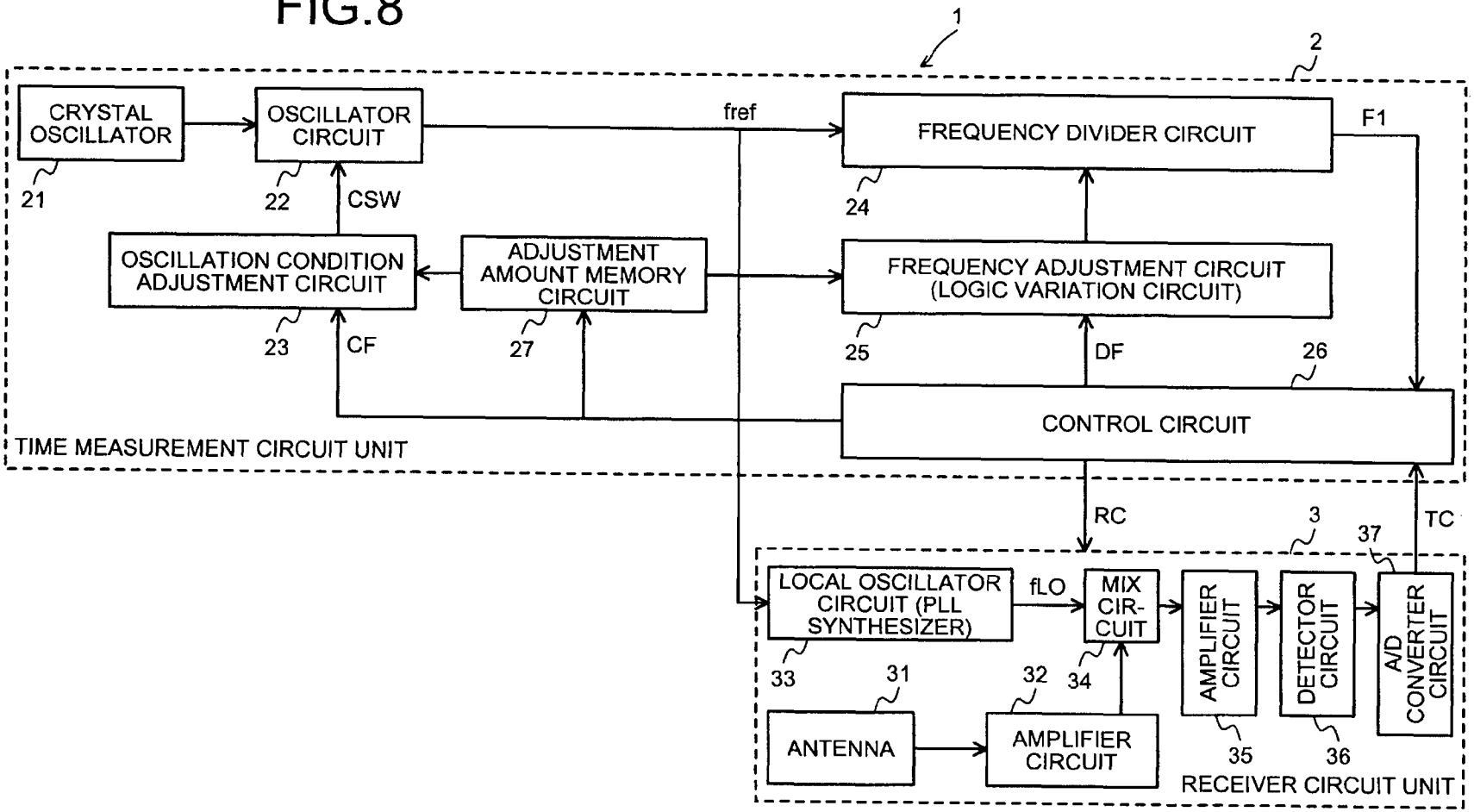
FIG. 8 is a block diagram depicting a configuration of the radio-controlled timepiece in a fourth embodiment.

The radio-controlled timepiece 1 in the fourth embodiment is configured as depicted in FIG. 8 and differs from the radio-controlled timepiece 1 in the first embodiment in that an adjustment amount memory circuit 27 is provided that stores a frequency adjustment value and variation setting value optimal for each reception channel in plural, and is configured such that each adjustment value optimal according to the control signals CF, DF from the control circuit 26 are called. In FIG. 8, components identical or similar to those depicted in FIG. 1 and described above are given the same reference numerals used in the first embodiment and description thereof is omitted.

(Configuration of Oscillator Circuit in Fourth Embodiment)

Figure 9:
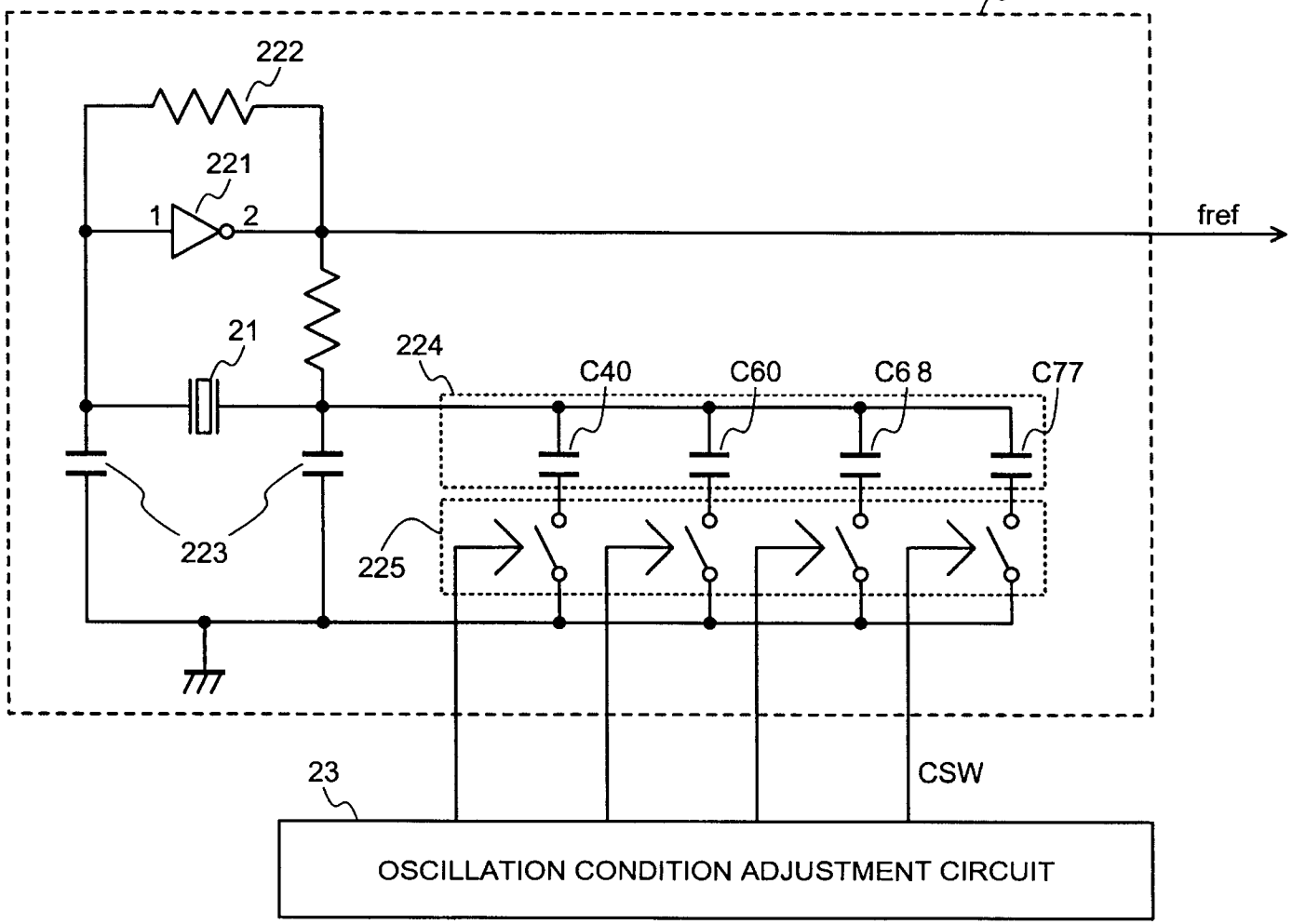
FIG. 9 is a circuit diagram depicting a configuration of the oscillator circuit in the fourth embodiment.

FIG. 9 depicts a detailed example of the oscillator circuit 22 in the fourth embodiment. The oscillator circuit 22 in the fourth embodiment differs from the oscillator circuit 22 in the first embodiment depicted in FIG. 3 in that the frequency-adjustment load capacitor 224 that performs frequency adjustment and the frequency adjustment switch 225 connecting in parallel the frequency-adjustment load capacitor 224 by the adjustment signal CSW of the oscillation condition adjustment circuit 23 to the load capacitors 223 are provided in plural. The capacitors C40, C60, C68, and C77 of the frequency-adjustment load capacitor 224, respectively, in each frequency 40 kHz, 60 kHz, 68.5 kHz, and 77.5 kHz are selected such that the reference frequency fref output to the local oscillator circuit 33 by the oscillator circuit 22 is optimal.

The reception frequencies above are for receiving standard time and frequency signals by wavelength; 40 kHz is the frequency for the eastern station of the Japanese standard frequency station (JJY); 60 kHz is the frequency for the western station of the Japanese standard frequency station (JJY), the American and the British standard time signal station; 68.5 kHz is for the Chinese standard time signal channel And 77.5 kHz is the frequency for the German standard time signal station.

(Time Correction Operations of Radio-Controlled Timepiece According to Fourth Embodiment)

Time correction operations by the radio-controlled timepiece 1 above and using standard time and frequency signals will be described. In the fourth embodiment as well, similar to the first embodiment, the operations at steps S400 to S406 in the flowchart depicted in FIG. 4 are performed. However, the present embodiment is characterized in that the frequency adjustment amount at step S401 in FIG. 4 differs for each reception frequency. Therefore, description of the operations at steps other than step S401 in FIG. 4 is omitted and detailed operations corresponding to step S401 of FIG. 4 in the fourth embodiment will be described using the flowchart depicted in FIG. 10.

Figure 10:
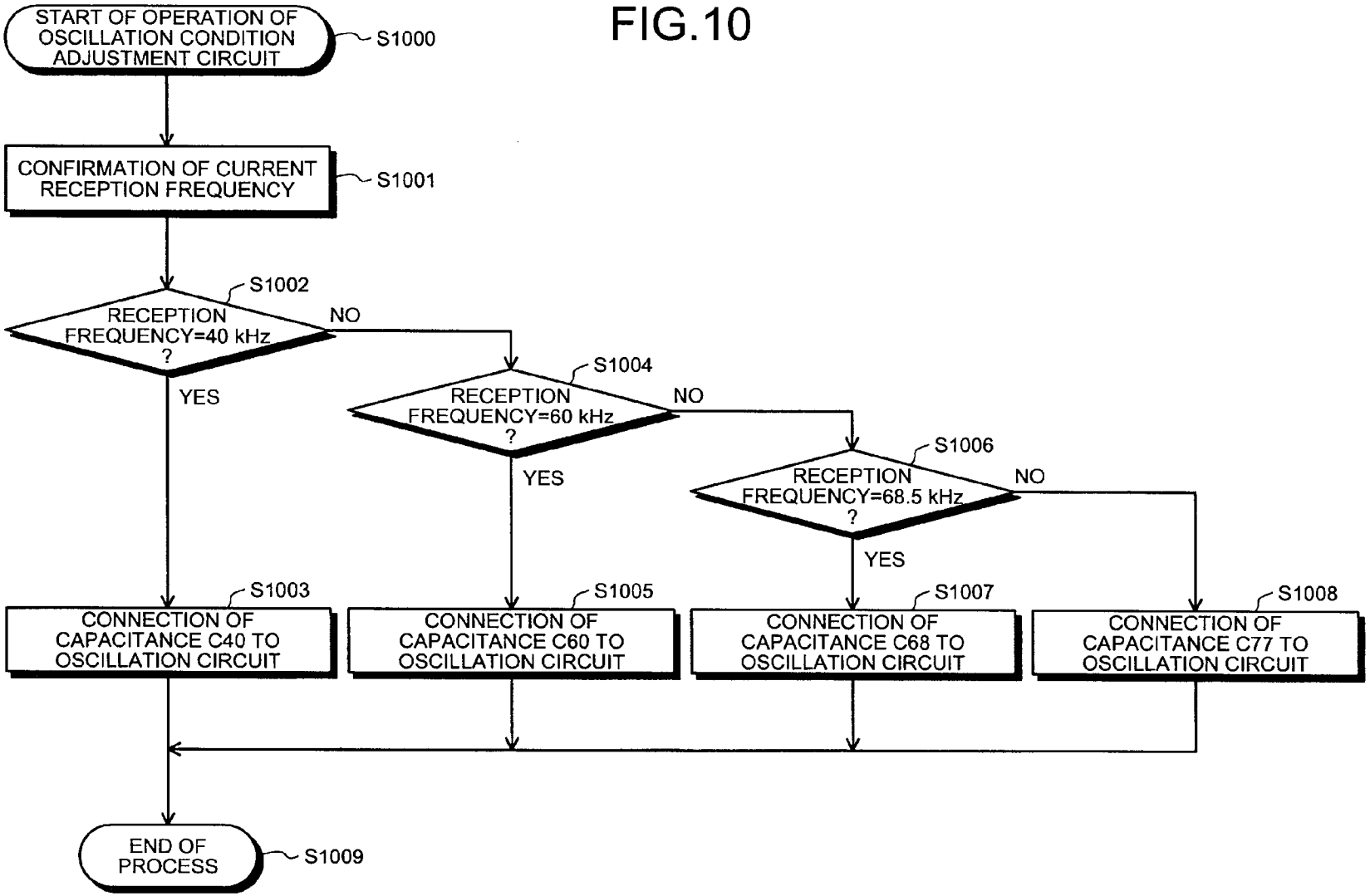
FIG. 10 is a flowchart depicting operations of an oscillation condition adjustment circuit of the radio-controlled timepiece in the fourth embodiment.

FIG. 10 is a flowchart depicting operations of the oscillation condition adjustment circuit 23 in the present embodiment. In FIG. 10, the oscillation condition adjustment circuit 23 commences operation (step S1000), and acquires, via the control circuit 26, frequency information for the reception channel currently being received (step S1001: "confirmation of current reception frequency"). The station performing reception and the received frequency are time display region set in the radio-controlled timepiece 1 by the control circuit 26 or suitably set by the field strength of each reception channel.

The oscillation condition adjustment circuit 23, based on the frequency information of the reception channel obtained by the control circuit 26 and frequency adjustment value information from the adjustment amount memory circuit 27, among the capacitors C40, C60, C68, and C77 of the frequency-adjustment load capacitor 224, selects a capacitance to be connected to (step S1002 to step S1006). The selected capacitance alone, via the frequency adjustment switch 225, is connected in parallel to the load capacitors 223 (step S1003 to step S1008), and the process ends (step S1009). In the operation at step S402 in FIG. 4, variation setting values according to reception frequencies are set in the frequency adjustment circuit 25.

By the operations above, the overall load capacitance of the oscillator circuit is changed, and the frequency f0 output from the oscillator circuit 22 is changed to the frequency frx optimal for the local oscillator circuit 33 at the current reception frequencies. (step S401 depicted in FIG. 4). Here, the value of the frequency frx differs according to the capacitors C40, C60, C68, and C77; and is a frequency optimal for each reception frequency corresponding to the capacities. Hereinafter, operations similar to step S402 to step S406 in FIG. 4 are performed.

(Effects of Fourth Embodiment)

In the fourth embodiment, an effect can be achieved in that with respect to multiple reception frequencies, the reference frequency can be further optimized. In other words, according to the fourth embodiment, to receive reception channels of multiple frequencies, even for a radio-controlled timepiece that requires the local oscillation frequency fLO in plural, the local oscillation frequency fLO optimal for each frequency can be obtained and at all the reception channels, functional effects identical to those of the first embodiment can be obtained.

In the fourth embodiment, by the operations o f the frequency adjustment circuit 25, during reception, variation setting value information optimal for each reception frequency are obtained from the adjustment amount memory circuit 27, whereby the period of the timing signals F1 output by the frequency divider circuit 24 become identical and similar to the second embodiment, even when the adjustment value of the frequency adjustment circuit 25 is fixed, the value of the frequency divider circuit 24 is directly corrected, whereby functional effects identical to those of the second embodiment can be obtained. In this case, in the calculation of the correction value, the amount of time drift may be calculated for each frequency.

In the fourth embodiment, although configuration is such that capacitors C40, C60, C68, and C77 corresponding to each reception frequency 40 kHz, 60 kHz, 68.5 kHz, and 77.5 kHz are selected, the present invention is not limited hereto. For example, the present invention may be the following modification examples (decoding scheme, time division scheme).

Configuration may be such that for each reception frequency, a single capacitor is not allocated, but rather by combining multiple capacitances, an optimal capacitance for each frequency can be selected (decoding scheme). In this manner, the number of capacitors used can be reduced, and the circuit configuration of the frequency-adjustment load capacitor 224 and the frequency adjustment switch 225 can be simplified.

Further, as described in the first embodiment, the frequency-adjustment load capacitor 224 is intermittently connected or disconnected and the connection time ratio thereof is changed according each reception frequency, whereby the frequency adjustment amount can also be changed (time division scheme). In this manner, the number of capacitors used can be 1 as in the first embodiment.

[Fifth Embodiment]

A fifth embodiment of the present invention will be described. In the fifth embodiment, an adjustment method of the radio-controlled timepiece 1 according to the first embodiment of the present invention will be described. In general, in the electronic time measurement where the crystal oscillator 21 is assumed to be the reference signal source, the reference frequency fref output from the oscillator circuit 22 changes consequent to properties of the disposed crystal oscillator 21 and of the elements of the oscillator circuit 22.

Thus, for the radio-controlled timepiece 1, at the manufacturing process, according to the frequency output by each oscillator circuit 22, a variation setting value differing according to the frequency adjustment circuit 25 is set. Through this process, even if the reference frequency fref of the oscillator circuit 22 drifts, a constant timing signal F1 can be obtained from the frequency divider circuit 24. Consequently, the accuracy of the timepiece is within 15 seconds per month.

In the radio-controlled timepiece 1 of the fifth embodiment, the reference frequency fref output by the oscillator circuit 22 differs for normal operations and reception. Therefore, in the first embodiment, the variation setting value in the frequency adjustment circuit 25 differs for normal operations and for reception. In a manufacturing process of the radio-controlled timepiece 1 of the fifth embodiment, the variation setting values for normal operations and reception have to be stored or set in the radio-controlled timepiece 1.

(Configuration of Fifth Embodiment)

Figure 11:
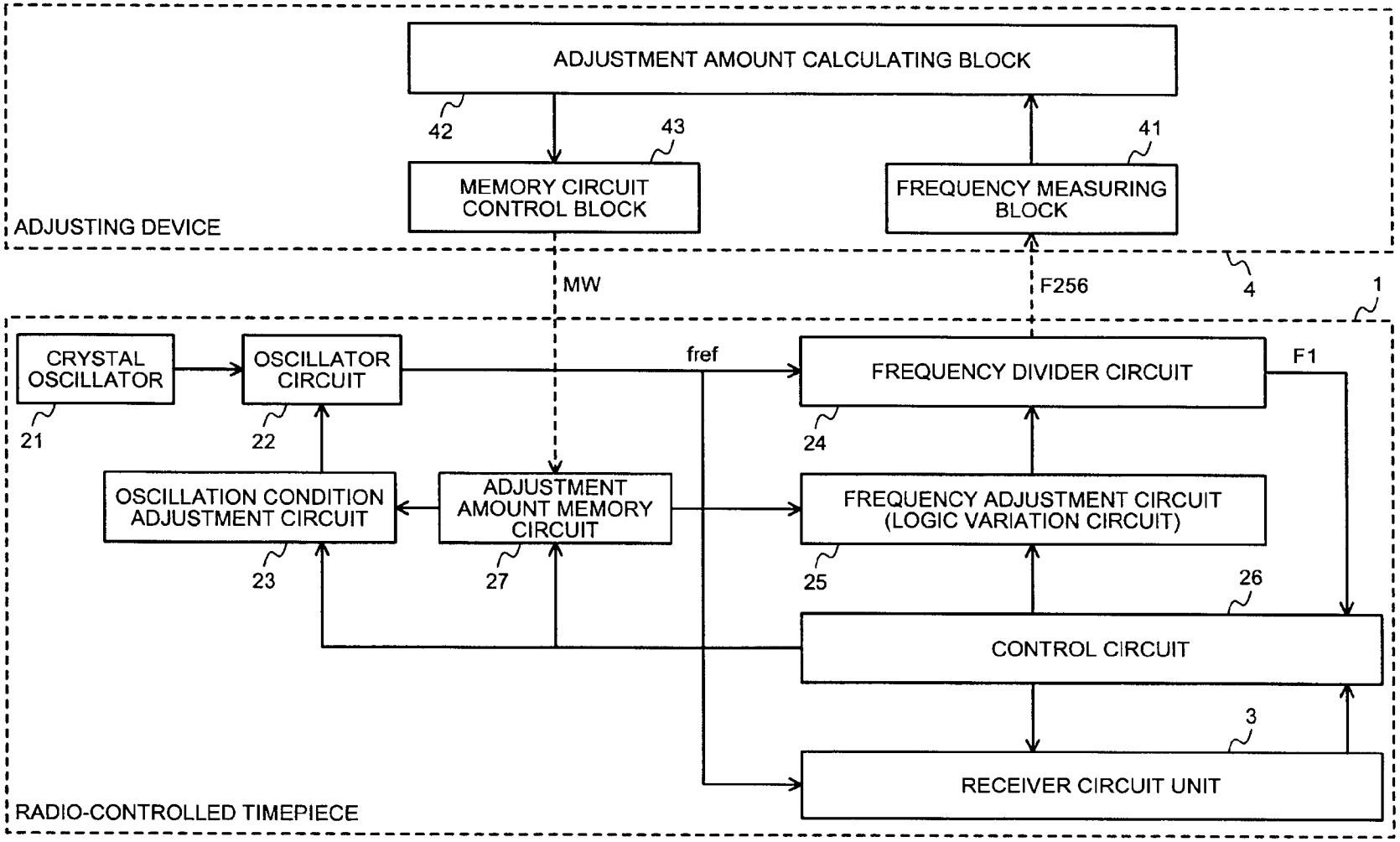
FIG. 11 is a block diagram depicting a configuration of the radio-controlled timepiece and an adjusting device in a fifth embodiment.

FIG. 11 depicts an example the radio-controlled timepiece 1 and an adjusting device 4 in the fifth embodiment. The adjusting device 4 includes a frequency measuring block 41 that measures frequency, an adjustment amount calculating block 42 that calculates adjustment amounts from each measured frequency, a memory circuit control block 43 that causes the adjustment amount memory circuit 27 of the radio-controlled timepiece 1 to store the obtained adjustment amounts.

In the block diagram of FIG. 1 in the first embodiment, although the adjustment amount memory circuit 27 of FIG. 11 is not depicted, in the radio-controlled timepiece 1 depicted in FIG. 1, a memory circuit corresponding to the adjustment amount memory circuit 27 is integrated in the control circuit 26. In the first embodiment, although description of this memory circuit has been omitted, in the present embodiment, for the ease of understanding in describing that the adjusting device 4 is used and the adjustment amount is stored to the radio-controlled timepiece 1, the adjustment amount memory circuit 27 is depicted as to be external of the control circuit 26. In FIG. 11, components identical or similar to those of the first embodiment depicted in FIG. 1 are given the same reference numerals used FIG. 1 and description thereof is omitted.

(Adjustment Process of Radio-Controlled Timepiece in Fifth Embodiment)

Figure 12:
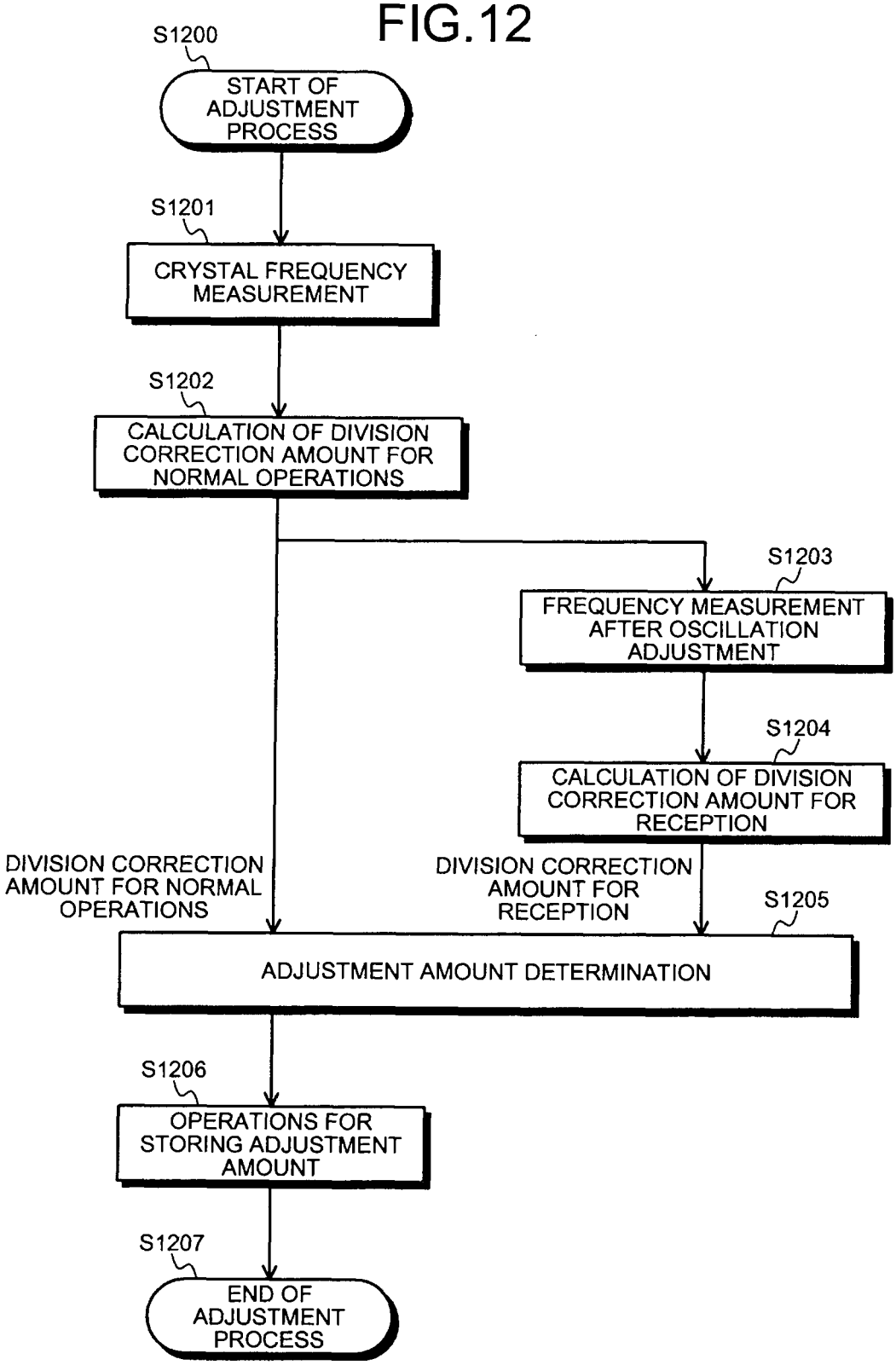
FIG. 12 is a flowchart depicting a frequency adjustment process of the radio-controlled timepiece in the fifth embodiment and using the adjustment device.

The radio-controlled timepiece 1 of the first embodiment is described in a case where the adjusting device 4 is used for adjustment. FIG. 12 is a flowchart depicting an adjustment process. In FIG. 12, when the adjustment process commences (step S1200), the frequency measuring block 41 uses a frequency measuring signal F256 output by the frequency divider circuit 24 of the radio-controlled timepiece 1 and measures the reference frequency fref output from the oscillator circuit 22 (step S1201: "crystal frequency measurement").

From the frequencies obtained by the frequency measuring block 41, the adjustment amount calculating block 42 calculates the amount of drift from the actual period of the timing signal F1, and calculates an variation setting value for normal operations such that the drift is corrected (step S1202: "calculation of division correction amount for normal operations"). So that the during reception, the same period as when the timing signal F1 is not being received is maintained, the adjustment amount calculating block 42 further measures the reference frequency fref during reception operations using the frequency measuring signal F256 (step S1203: "frequency measurement after oscillation adjustment"); calculates, from the measurement results, the amount of drift from the actual period of the timing signal F1 during reception; and calculates an variation setting value such that the drift is corrected during reception operations (step S1204: "calculation of division correction amount for reception").

Thus, an variation setting value for normal operations and an variation setting value for reception are determined (step S1205: "adjustment amount determination"). Finally, the adjusting device 4, via the memory circuit control block 43, transfers the variation setting values and frequency adjustment amounts to the radio-controlled timepiece 1, causes the value and the amount to be set or stored (step S1206: "operations for storing adjustment amount"), and ends the adjustment process (step S1207).

By the operations above, the variation setting value of the frequency adjustment circuit 25 in the radio-controlled timepiece 1 of the first embodiment is suitably determined according to the drift of the reference frequency fref of the oscillator circuit 22 and recorded in the radio-controlled timepiece 1. Therefore, irrespective of the operation state being for normal operations or reception operations, the time measurement accuracy of the radio-controlled timepiece 1 can be suppressed to within 15 seconds per month, and during reception operations, since the local oscillation frequency fLO can be obtained more accurately, a highly accurate radio-controlled timepiece can be provided.

(Effect of Fifth Embodiment)

In this manner, according to the fifth embodiment, even if the reference frequency fref (oscillation) output from the oscillator circuit 22 drifts and the reference frequency fref changes consequent to the oscillation condition adjustment circuit 23 during reception, an optimal variation setting value can be set for the frequency adjustment circuit 25, and the radio-controlled timepiece 1 that can accurately measure time can be provided.

For the same reasons as in the first embodiment, even during reception operations, the same time measurement accuracy as during normal operations can be maintained and therefore, time display during reception operations can be performed accurately and the period of the timing signal F1 used in the decoding process of the digital signal TC by the control circuit 26 can be accurately maintained and the decoding process can be accurately performed.

[Sixth Embodiment]

A sixth embodiment of the present invention will be described. In the fifth embodiment, although the adjustment method of the radio-controlled timepiece 1 in the first embodiment has been described, the adjustment method can be used widely in adjustments of the radio-controlled timepiece of the present invention. For example, a case where the radio-controlled timepiece 1 of second embodiment uses the adjusting device 4 and performs adjustment is similar to a case where the radio-controlled timepiece 1 of the first embodiment performs control.

In the radio-controlled timepiece 1 of second embodiment depicted in FIG. 5, configuration is such that only in the case of reception failure correction is performed, where the time measurement error summed during reception is calculated from the time required for the reception process at step S603 in FIG. 6 as measured by the non-depicted time measuring unit integrated into the control circuit 26. Therefore, by using the adjusting device 4 in FIG. 11, measuring the frequency measuring signal F256 (not depicted in FIG. 5) of the reference frequency fref during reception operations by the frequency measuring block 41, the adjustment amount calculating block 42 calculates the amount of drift from the actual period of the timing signal F1 from the results, and by causing the drift to be set or stored in the control circuit 26 of FIG. 5, the control circuit 26 can calculate the time measurement error summed during reception.

By the method above, in the radio-controlled timepiece 1 of the second embodiment, adjustment similar to that in the fifth embodiment is enabled, and even if the reference frequency fref (oscillation) output from the oscillator circuit 22 drifts and the reference frequency fref changes consequent to the operations of the oscillation condition adjustment circuit 23 during reception, the control circuit 26 can calculate/correct the time measurement error summed during reception and the radio-controlled timepiece 1 that can accurately measure time can be provided.

[Seventh Embodiment]

A seventh embodiment of the present invention will be described. As with the radio-controlled timepiece 1 of the fourth embodiment depicted in FIG. 8, configuration may be such that when there are multiple reference frequencies fref during reception operations, measurement is performed for the reference frequency fref of each of the reception channels and a variation setting value is set for each frequency.

Further, as with the radio-controlled timepiece 1 of the fourth embodiment, in a case where the reference frequency fref output from the oscillator circuit 22 when the oscillation condition adjustment circuit 23 is operated can be varied, in addition to the setting of the variation setting value, the amount that the reference frequency fref output from the oscillator circuit 22 when the oscillation condition adjustment circuit 23 is operated is to be changed has to be set.

Figure 13:
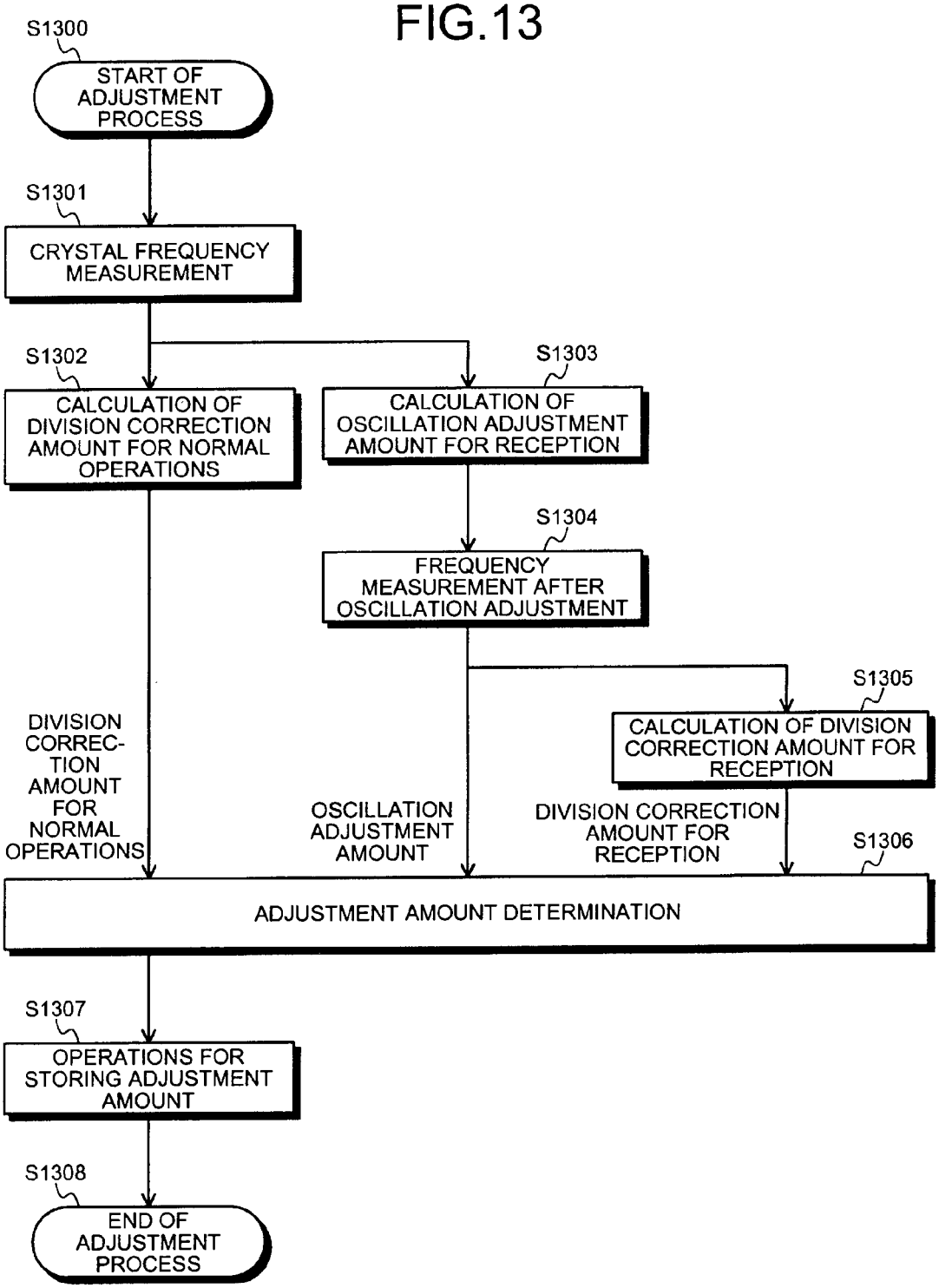
FIG. 13 is a flowchart depicting the frequency adjustment process of the radio-controlled timepiece using the adjustment device in a seventh embodiment.

In the seventh embodiment, the adjustment method of the radio-controlled timepiece 1 in the fourth embodiment will be described using the flowchart in FIG. 13. In FIG. 13, when the adjustment process commences (step S1300), the frequency measuring block 41 uses the frequency measuring signal F256 (not depicted in FIG. 8) output by the frequency divider circuit 24 of the radio-controlled timepiece 1 to measure the reference frequency fref output from the oscillator circuit 22 (step S1301: "crystal frequency measurement").

From the frequency obtained by the frequency measuring block 41, the adjustment amount calculating block 42 calculates the amount of drift from the actual period of the timing signal F1, and calculates an variation setting value for normal operations such that the drift is corrected (step S1302: "calculation of division correction amount for normal operations").

Similarly, the adjustment amount calculating block 42 calculates the amount of drift from the optimal frequency for the local oscillator circuit 33 at the time of reception from the frequency obtained by the frequency measuring block 41, and from the amount of drift, calculates the oscillation adjustment amount to be used during reception operations (step S1303: "calculation of oscillation adjustment amount for reception").

Further, so that the during reception, the same period as when the timing signal F1 is not being received is maintained, the adjustment amount calculating block 42 measures the reference frequency fref during reception operations using the frequency measuring signal F256 (step S1304: "frequency measurement after oscillation adjustment"); calculates from the measurement results, the amount of drift from the actual period of the timing signal F1 during reception; and calculates a variation setting value for reception operations such that the drift is corrected (step S1305: "calculation of division correction amount for reception").

Thus, a variation setting value for normal operations, a frequency adjustment amount and variation setting value for reception operations are determined (step S1306: "adjustment amount determination"). Finally, the adjusting device 4, via the memory circuit control block 43, transfers the variation setting values and the frequency adjustment amount to the radio-controlled timepiece 1, causes the values and the amount to be stored to the adjustment amount memory circuit 27 (step S1307: "operations for storing adjustment amount"), and ends the adjustment process (step S1308).

By the operations above, the variation setting value of the frequency adjustment circuit 25 and the frequency adjustment amount of the oscillation condition adjustment circuit 23 of the radio-controlled timepiece 1 in the seventh embodiment are optimally determined according to the drift of the reference frequency fref of the oscillator circuit 22 and stored in the radio-controlled timepiece 1. Therefore, irrespective of the operation state being for normal operations or reception operations, the time measurement accuracy of the radio-controlled timepiece 1 can be suppressed to within 15 seconds per month, and during reception operations, since the local oscillation frequency fLO can be obtained more accurately, a highly accurate radio-controlled timepiece can be provided.

[Eighth Embodiment]

Figure 14:
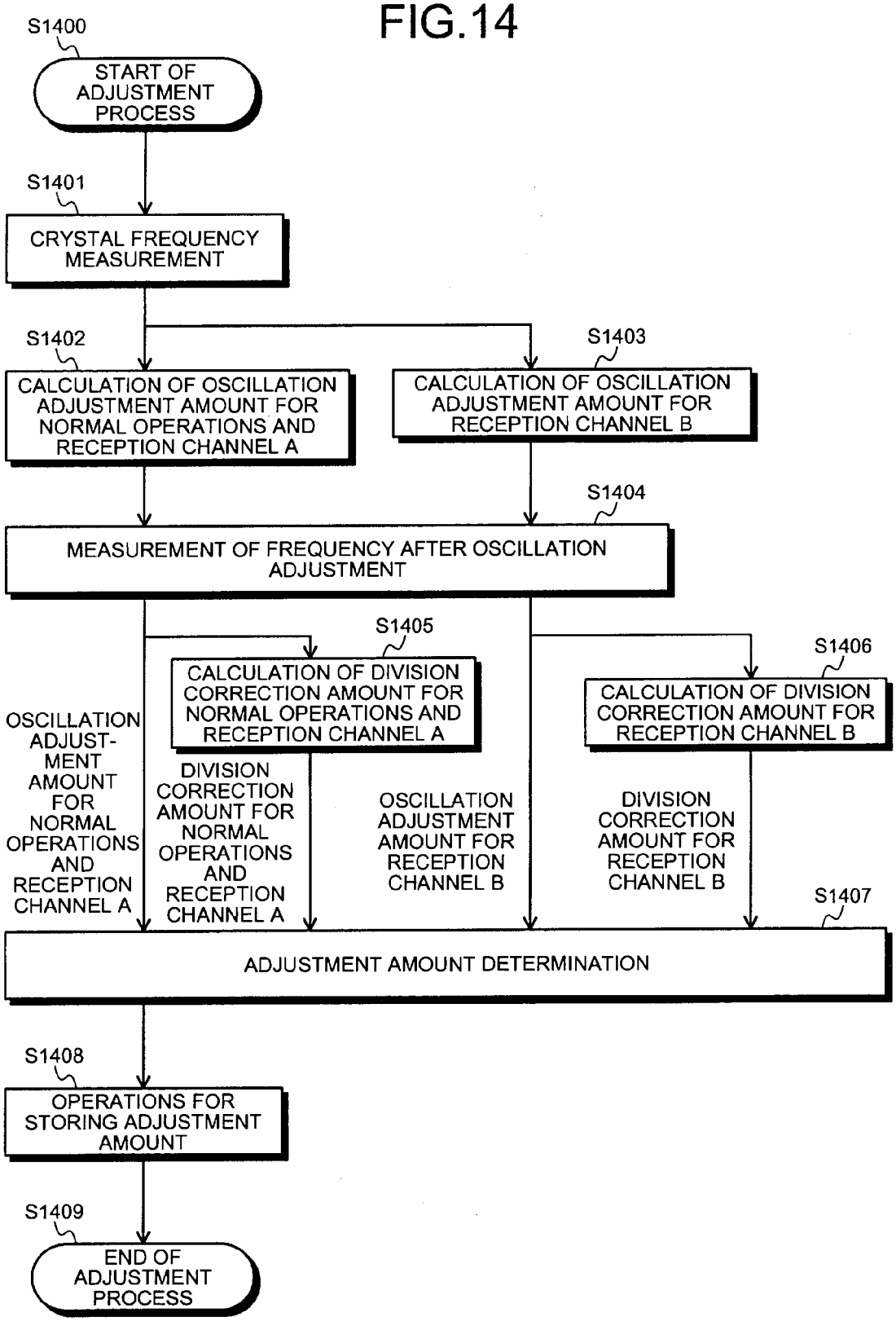
FIG. 14 is a flowchart depicting the frequency adjustment process of the radio-controlled timepiece using the adjustment device in an eighth embodiment.

An eighth embodiment of the present invention will be described. In the eighth embodiment, configuration is such that the frequency of the oscillator circuit 22 during non-reception is set to be the same frequency as the optimal frequency of the oscillator circuit 22 when channel A (any among plural radio waves), and by setting the variation setting value of the frequency divider circuit 24 to coincide with the frequency of the oscillator circuit 22, in a case where the state transitions from a non-receiving state to reception of channel A, the frequency of the oscillator circuit 22 and the variation setting value of the frequency divider circuit 24 do not changed. FIG. 14 depicts a flowchart of the adjustment process in the case of the eighth embodiment. For example, an example is depicted of a case where other than channel A, channel B can be received. A block diagram of the radio wave correcting timepiece 1 of the eighth embodiment is identical to that of the fourth embodiment depicted in FIG. 8.

In FIG. 14, when adjustment process commences (step S1400), the frequency measuring block 41 uses the frequency measuring signal F256 (not depicted in FIG. 8) output from the frequency divider circuit 24 of the radio-controlled timepiece 1 and measures the reference frequency fref output from the oscillator circuit 22 (step S1401: "crystal frequency measurement").

From the frequency obtained by the frequency measuring block 41, the adjustment amount calculating block 42 calculates the amount of drift from the optimal frequency of the local oscillator circuit 33 during normal operation and reception of channel A, and from the drift, calculates the oscillation adjustment amount for reception operations (step S1402: "calculation of oscillation adjustment amount for normal operations and reception channel A"). Similarly, from the frequency obtained by the frequency measuring block 41, the adjustment amount calculating block 42 calculates the amount of drift from the optimal frequency for the local oscillator circuit 33 during reception of channel B, and from the drift, calculates the oscillation adjustment amount for reception operations (step S1403: "calculation of oscillation adjustment amount for reception channel B").

Further, so that during reception, the same period as when the timing signal F1 is not being received is maintained, the adjustment amount calculating block 42 measures the respective reference frequencies fref of channel A and channel B for reception operations using the frequency measuring signal F256 (step S1404: "measurement of frequency after oscillation adjustment"); calculates from the measurement results, the amount of drift from the actual period of the timing signal F1 during reception; and calculates a variation setting value for normal operations and reception of channel A such that the drift is corrected (step S1405: "calculation of division correction amount for normal operations and reception channel A"); and calculates a variation setting value for reception of channel B (step S1406: "calculation of division correction amount for reception channel B").

Thus, based on an oscillation adjustment amount for normal operations and reception of channel A, a division correction amount for normal times and reception of channel A, an oscillation adjustment amount for reception of channel B, and a division correction amount for reception of channel B, a variation setting value for normal operations and, a frequency adjustment amount and a variation setting value for reception operations are determined (step S1407: "adjustment amount determination"). Finally, the adjusting device 4, via the memory circuit control block 43, transfers the variation setting values and the frequency adjustment amount to the radio-controlled timepiece 1, causes the variation setting values and the frequency adjustment amount to be stored to the adjustment amount memory circuit 27 (step S1408: "operations for storing adjustment amount"); and ends the adjustment process (step S1409).

In the present embodiment, although the oscillation condition of the oscillator circuit 22 for reception of channel A and times of non-reception do not differ, for reception of channel B and times of non-reception, the oscillation condition of the oscillator circuit 22 differs. In the example depicted in FIG. 14, although only 2 channels, channel A and channel B are described, configuration is not limited to 2 channels and as depicted in FIG. 10, may be 4 channels.

[Ninth Embodiment]

A ninth embodiment according to the present invention will be described. In the fifth embodiment, to adjust the radio-controlled timepiece 1, a special adjusting device 4 is provided and the operation of which yields the frequency adjustment amount and the variation setting value for reception operations. Since the adjusting device 4 is also used with a general electronic time measurement, the variation setting value for normal operations alone may be stored to the radio-controlled timepiece 1, and on the timepiece side, the adjustment amount may be calculated as needed.

Figure 15:
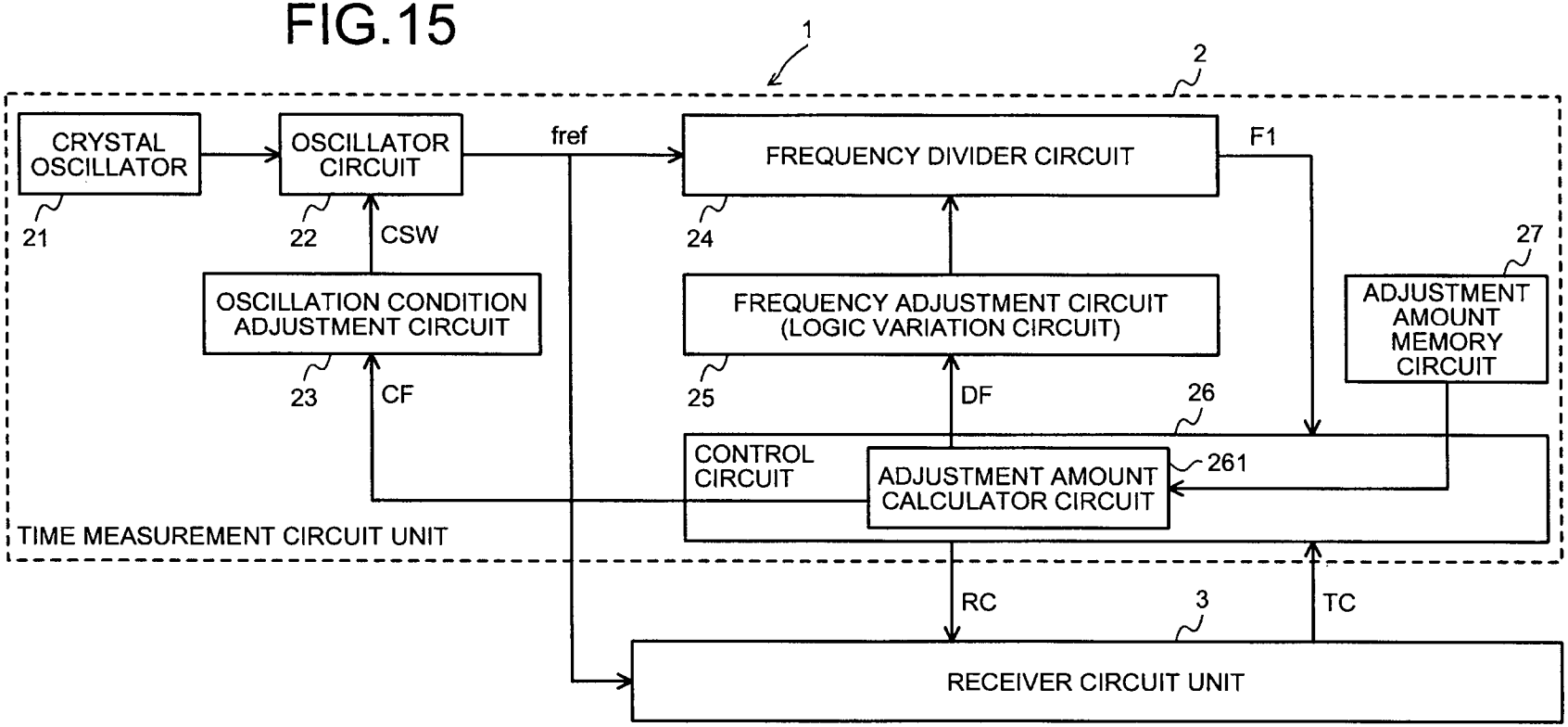
FIG. 15 is a block diagram of a configuration of the radio-controlled timepiece in a ninth embodiment.

Configuration of the radio-controlled timepiece 1 in the ninth embodiment will be described using FIG. 15. In FIG. 15, components identical or similar to those of the first embodiment depicted in FIG. 1 are given the same reference numerals used in the first embodiment and description thereof is omitted. In FIG. 15, the radio-controlled timepiece 1 has a built-in adjustment amount calculator circuit 261 that calculates the adjustment amount within the control circuit 26.

The adjustment amount calculator circuit 261 can calculate the variation setting value for normal operation stored in the adjustment amount memory circuit 27 and the reference frequency fref of the oscillator circuit 22 for normal operation, obtain the difference from the optimal frequency for the local oscillator circuit 33 (not depicted) in the receiver circuit unit 3 during set reception times, and obtain the frequency adjustment amount of the oscillation condition adjustment circuit 23. Further, the difference of the reference frequency fref of the oscillator circuit 22 from the frequency for normal operations and during reception can be obtained, and the variation adjustment value that is to be set in the frequency adjustment circuit 25 during reception can be obtained.

Time correction operations by the radio-controlled timepiece 1 in the ninth embodiment using standard time and frequency signals will be described. Time correction operations of the radio-controlled timepiece 1 in the ninth embodiment are similar to those described in the first embodiment. However, the oscillation condition adjustment at step S401 and the variation adjustment at step S402 in the flowchart depicted in FIG. 4 are characterized in that, instead of the preliminarily stored adjustment amount, adjustment is performed using an adjustment amount obtained from the operation of the adjustment amount calculator circuit 261.

Figure 16:
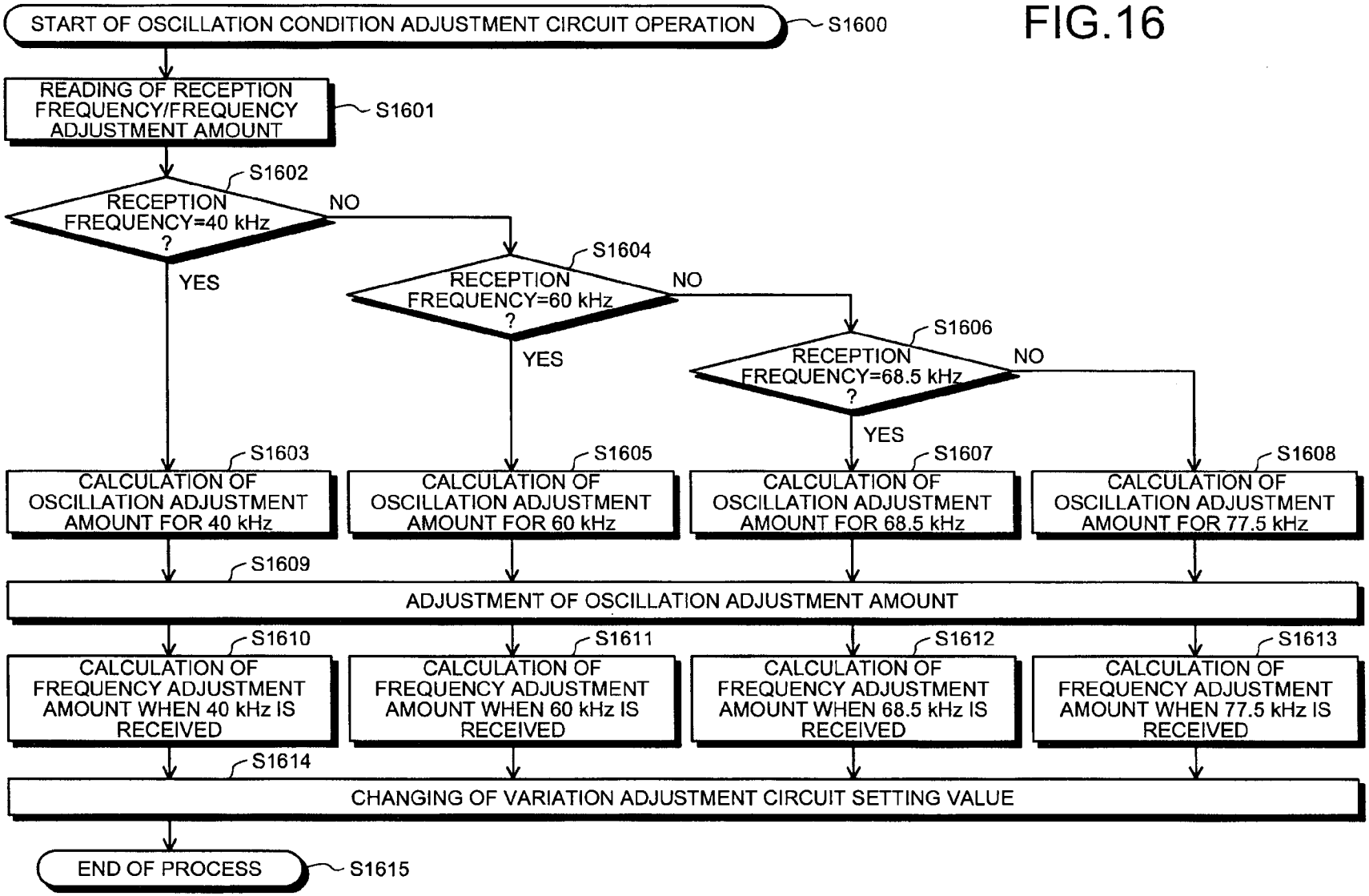
FIG. 16 is a flowchart depicting the operations of the oscillation condition adjustment circuit 23 of the radio-controlled timepiece 1 in the ninth embodiment.

FIG. 16 is a flowchart of the operations of the oscillation condition adjustment circuit 23, the control circuit 26, and the adjustment amount calculator circuit 261 in the ninth embodiment. In FIG. 16, the adjustment amount calculator circuit 261 commences operation (step S1600), the control circuit 26 obtains frequency information for the reception channel currently being received and the adjustment amount memory circuit 27 obtains the variation setting value for normal operation (step S1601: "reading of reception frequencies/frequency adjustment amount"). The channel to be received and the reception frequency are suitably set by the control circuit 26 according to time display region set in the radio-controlled timepiece 1 and the field strength of each reception channel.

The adjustment amount calculator circuit 261, based on the frequency information of the reception channel obtained by the control circuit 26 and the variation setting value for normal operation information from the adjustment amount memory circuit 27, calculates via the oscillation condition adjustment circuit 23, the adjustment amount for the reference frequency fref (step S1602 to step S1608). The control circuit 26 sets the adjustment amount calculated by the adjustment amount calculator circuit 261 in the oscillation condition adjustment circuit 23, and changes the oscillation frequency (step S1609: "adjustment of oscillation adjustment amount").

The adjustment amount calculator circuit 261 obtains the difference of the reference frequency fref obtained from the oscillator circuit 22 at this time and the reference frequency fref for normal times, and calculates the variation adjustment value (frequency adjustment amount) to be set in the frequency adjustment circuit 25 (step S1610 to step S1613). The control circuit 26 sets the variation adjustment value calculated by the adjustment amount calculator circuit 261 in the frequency adjustment circuit 25 (step S1614: "changing of variation adjustment circuit setting value"), and ends the process (step S1615).

In this manner, according to the ninth embodiment, even if a special adjusting device 4 is not provided to adjust the radio-controlled timepiece 1, by an adjusting device for adjusting general electronic time measurement, effects similar to those of the fifth embodiment can be obtained. Further, even in a case where multiple models of the radio-controlled timepiece 1 are present, and the oscillation adjustment amount and the frequency adjustment amount changes for each model, the adjusting device 4 can be commonized, enabling the adjustment process to be simplified.

Correction of time measurement drifts with respect to time measurement during non-reception and occurring with time measurement during reception is not limited to the methods described in each of the embodiments above and correction may be performed by another method. For example, when the oscillation frequency of the oscillator circuit 22 during reception changes from frequency f0 to frequency frx, after reception operations have stopped, the oscillation frequency of the oscillator circuit 22 may be corrected by setting the frequency to f0', which differs from f0, for a period of time that is the same as the period of time required for reception. In this case, when the frequency frx is a frequency having a period that is longer than that of the oscillation frequency f0 during reception, frequency f0' may be set to a frequency having a period that is shorter than that of frequency f0, and when frequency frx is a frequency having a period that is shorter than that of frequency f0, frequency f0' may be set to a frequency having a period that is longer than that of frequency f0.

In the fourth embodiment, when a radio wave from an external source is received, by changing the capacitance of the frequency-adjustment load capacitor 224, the oscillation frequency of the oscillator circuit 22 is adjusted; and by changing the division factor of the frequency divider circuit 24 via the frequency adjustment circuit 25, the period of the timing signal F1 is adjusted. In comparing the smallest adjustment amount by the period of the oscillation frequency of the oscillator circuit 22 in the former adjustment and the smallest adjustment amount by the period of the timing signal F1 in the latter method, the adjustment amount in the latter adjustment is larger and the adjustment thereof is coarse.

Therefore, the load capacitance in the former adjustment has to be adjusted for each reception frequency of multiple reception channels, whereas even if the same division factor is set for 2 reception frequencies in the latter adjustment, if the load capacitance adjustment between 2 reception frequencies is 2 fewer, the period of the timing signal F1 can be adjusted to a sufficient accuracy. In this manner, at multiple reception frequencies, by setting the same division factor for the frequency divider circuit 24, the variation setting value can be shared by multiple reception frequencies, enabling reductions in the storage volume of the adjustment amount memory circuit 27 storing the variation setting values.

In other words, when a given number of frequency adjustment values, which are information for changing the capacitance of the load capacitor 224, are stored in the adjustment amount memory circuit 27, variation setting values of a number less that the given number can be stored in the adjustment amount memory circuit 27, whereby the storage volume of the adjustment amount memory circuit 27 can be reduced.

When the variation setting value cannot not be shared among multiple reception frequencies, for each reception frequency, 1 combination of a frequency adjustment value and variation setting value may be correlated and stored. In other words, the same number of the frequency adjustment values, which are information for changing the capacitance of the load capacitor 224, and the variation setting values, which are information for adjusting the division factors of the frequency divider circuit 24, may be stored.

In each of the embodiments, the oscillation condition of the oscillator circuit 22 is not necessarily changed at the reception of standard time and frequency signals, and only in an environment where reception cannot be favorably performed, the oscillation condition of the oscillator circuit 22 is changed, enabling the reception sensitivity to be improved. In this case, whether the environment is one where favorable reception cannot be performed can be determined by whether numerous errors occurred in past reception results. In this manner, even during reception of standard time and frequency signals, by not changing the oscillation condition of the oscillator circuit 22 when not necessary, the power consumption of the oscillator circuit 22 during the reception of standard time and frequency signals can be prevented from increasing.

EXPLANATIONS OF LETTERS OR NUMERALS

1 radio-controlled timepiece
2 time measurement circuit unit
3 receiver circuit unit
4 adjusting device
21 crystal oscillator
22 oscillator circuit
23 oscillation condition adjustment circuit
24 frequency divider circuit
25 frequency adjustment circuit
26 control circuit
27 adjustment amount memory circuit
31 antenna
32, 35 amplifier circuit
33 local oscillator circuits
34 MIX circuit
36 detector circuit
37 A/D converter circuit
41 frequency measuring block
42 adjustment amount calculating block
43 memory circuit control block
221 inverter circuit

222 feedback resistor
223 load capacitor
224 frequency-adjustment load capacitor
225 frequency adjustment switch
261 adjustment amount calculator circuit
C40 40 kHz load capacitor for reception
C60 60 kHz load capacitor for reception
C68 68.5 kHz load capacitor for reception
C77 77.5 kHz load capacitor for reception

The invention claimed is:

1. A radio-controlled timepiece comprising:

a timepiece measuring circuit configured to serve as a reference signal source during a time measurement;

a heterodyne receiver circuit configured to receive radio waves from an external source;

a PLL circuit configured to generate a local oscillation frequency used by the heterodyne receiver circuit, wherein the timepiece measuring circuit serves as a reference frequency generating unit that generates a reference frequency of the PLL circuit;

a control unit that changes an oscillation condition of the timepiece measuring circuit, based on a reception and a non-reception of the radio waves from the external source, the control unit changing the oscillation condition of the timepiece measuring circuit such that the oscillation frequency of the timepiece measuring circuit differs based on the reception and the non-reception of the radio waves from the external source; and a correcting unit that corrects a time measurement drift of a time measurement during the reception of the radio waves from the external source that is relative to a time measurement during the non-reception of the radio waves from the external source, the time measurement drift being consequent to the oscillation frequency of the timepiece measuring circuit differing based on the reception and the non-reception of the radio waves from the external source.

2. The radio-controlled timepiece according to claim 1, wherein the control unit changes a load capacitance value of the timepiece measuring circuit as the oscillation condition of the timepiece measuring circuit.

3. The radio-controlled timepiece according to claim 2, wherein the load capacitance value is set to be greater during the reception of the radio waves from the external source than during the non-reception of the radio waves from the external source.

4. The radio-controlled timepiece according to claim 2, wherein the heterodyne receiver circuit is configured to receive multiple frequencies of the radio waves from the external source, and the load capacitance value is a capacitance value that is set to differ for each reception frequency.

5. The radio-controlled timepiece according to claim 4, further comprising:

a frequency divider circuit that divides a signal of the timepiece measuring circuit and generates various timing signals;

a logic variation circuit that performs accuracy correction of a period of a time measurement signal output from the frequency divider circuit, by adjusting a division factor of the frequency divider circuit;

a storage unit that stores information of a given number corresponding to each reception frequency and for changing the load capacitance value, and information of a number less than the given number and for making the division factor of the frequency divider circuit differ by the logic variation circuit, wherein a smallest changing amount of the period when the period of the measurement signal is changed by the logic variation circuit is greater than a smallest changing amount of the period when the oscillation period of the timepiece measuring circuit is changed by changing the load capacitance value.

6. The radio-controlled timepiece according to claim 1, further comprising:

a frequency divider circuit that divides a signal of the timepiece measuring circuit and generates various timing signals; and a logic variation circuit that performs accuracy correction of a period of a time measurement signal output from the frequency divider circuit by adjusting a division factor of the frequency divider circuit, wherein the logic variation circuit is used as the correcting unit for correcting the time measurement drift by causing the division factor of the frequency divider circuit to differ for the reception and for the non-reception of the radio waves from the external source.

7. The radio-controlled timepiece according to claim 1, further comprising:

a frequency divider circuit that divides a signal of the timepiece measuring circuit and generates various timing signals; and a reception time measuring unit that measures a time consumed for the reception of the radio waves from the external source, wherein when the reception of the radio waves from the external source fails, the control unit adjusts the frequency divider circuit based on a measurement value of the reception time measuring unit and corrects the time measurement drift, whereby the correcting unit is configured by the reception time measuring unit and the control unit.

8. The radio-controlled timepiece according to claim 1, wherein the heterodyne receiver circuit is separate from the timepiece measuring circuit, and the PLL circuit is disposed within the heterodyne receiver circuit.

9. The radio-controlled timepiece according to claim 1, wherein the PLL circuit is configured to generate the local oscillation frequency used by the heterodyne receiver circuit by a phase comparison with the reference signal from the timepiece measuring circuit.

10. A radio-controlled timepiece comprising:

a timepiece measuring circuit configured to generate a reference frequency signal during a time measurement;

a heterodyne receiver circuit configured to receive radio waves from an external source;

a PLL circuit configured to generate a local oscillation frequency used by the heterodyne receiver circuit;

a control unit programmed to change an oscillation condition of the timepiece measuring circuit such that an oscillation frequency of the reference frequency signal generated by the timepiece measuring circuit varies based on a reception and a non-reception of the radio waves from the external source; and a correcting unit that corrects a time measurement drift of a time measurement during the reception of the radio waves from the external source that is relative to a time measurement during the non-reception of the radio waves from the external source, the time measurement drift being consequent to the oscillation frequency of the timepiece measuring circuit differing based on the reception and the non-reception of the radio waves from the external source.

11. The radio-controlled timepiece according to claim 10, wherein the control unit is programmed to change a load capacitance value of the timepiece measuring circuit as the oscillation condition of the timepiece measuring circuit.

12. The radio-controlled timepiece according to claim 11, wherein the load capacitance value is set to be greater during the reception of the radio waves from the external source than during the non-reception of the radio waves from the external source.

13. The radio-controlled timepiece according to claim 11, wherein the heterodyne receiver circuit is configured to receive multiple frequencies of the radio waves from the external source, and the load capacitance value is a capacitance value that is set to differ for each reception frequency.

14. The radio-controlled timepiece according to claim 13, further comprising:

a frequency divider circuit that divides the reference frequency signal generated by the timepiece measuring circuit and generates various timing signals;

a logic variation circuit that performs accuracy correction of a period of a time measurement signal output from the frequency divider circuit, by adjusting a division factor of the frequency divider circuit;

a storage unit that stores information of a given number corresponding to each reception frequency and for changing the load capacitance value, and information of a number less than the given number and for making the division factor of the frequency divider circuit differ by the logic variation circuit, wherein a smallest changing amount of the period when the period of the measurement signal is changed by the logic variation circuit is greater than a smallest changing amount of the period when the oscillation period of the timepiece measuring circuit is changed by changing the load capacitance value.

15. The radio-controlled timepiece according to claim 10, further comprising:

a frequency divider circuit that divides the reference frequency signal generated by the timepiece measuring circuit and generates various timing signals; and a logic variation circuit that performs accuracy correction of a period of a time measurement signal output from the frequency divider circuit by adjusting a division factor of the frequency divider circuit, wherein the logic variation circuit is used as the correcting unit for correcting the time measurement drift by causing the division factor of the frequency divider circuit to differ for the reception and for the non-reception of the radio waves from the external source.

16. The radio-controlled timepiece according to claim 10, further comprising:

a frequency divider circuit that divides the reference frequency signal generated by the timepiece measuring circuit and generates various timing signals; and a reception time measuring unit that measures a time consumed for the reception of the radio waves from the external source, wherein when the reception of the radio waves from the external source fails, the control unit is programmed to adjust the frequency divider circuit based on a measurement value of the reception time measuring unit and corrects the time measurement drift, whereby the correcting unit is configured by the reception time measuring unit and the control unit.

17. The radio-controlled timepiece according to claim 10, wherein the heterodyne receiver circuit is separate from the timepiece measuring circuit, and the PLL circuit is disposed within the heterodyne receiver circuit.

18. The radio-controlled timepiece according to claim 10, wherein the PLL circuit is configured to generate the local oscillation frequency used by the heterodyne receiver circuit by a phase comparison with the reference frequency signal generated by the timepiece measuring circuit.

* * * * *